US008910319B2

(12) United States Patent
Dainese et al.

(10) Patent No.: US 8,910,319 B2
(45) Date of Patent: Dec. 16, 2014

(54) GARMENT ADAPTED TO BE ASSOCIATED TO A DEVICE FOR THE PERSONAL PROTECTION OF A USER

(75) Inventors: Lino Dainese, Molvena (IT); Luigi Ronco, Molvena (IT); Alessandro Bellati, Molvena (IT)

(73) Assignee: Dainese S.p.A., Molvena (IT)

( * ) Notice: Subject to any disclaimer, the term of this patent is extended or adjusted under 35 U.S.C. 154(b) by 670 days.

(21) Appl. No.: 13/133,468

(22) PCT Filed: Dec. 4, 2009

(86) PCT No.: PCT/IB2009/055516
§ 371 (c)(1), (2), (4) Date: Sep. 26, 2011

(87) PCT Pub. No.: WO2010/067289
PCT Pub. Date: Jun. 17, 2010

(65) Prior Publication Data

US 2012/0023648 A1 Feb. 2, 2012

(30) Foreign Application Priority Data

| | | |
|---|---|---|
| Dec. 9, 2008 | (IT) | RM2008A0656 |
| Dec. 9, 2008 | (IT) | RM2008A0657 |
| Mar. 25, 2009 | (IT) | VR2009A0039 |
| Apr. 24, 2009 | (IT) | VR2009A0059 |

(51) Int. Cl.
*A41D 13/12* (2006.01)
*A41D 13/018* (2006.01)

(52) U.S. Cl.
CPC ..... *A41D 13/018* (2013.01)
USPC ..... 2/456

(58) Field of Classification Search
USPC ..... 2/2.11, 252, 455, 456, 463–465, 468
See application file for complete search history.

(56) References Cited

U.S. PATENT DOCUMENTS

| | | | | |
|---|---|---|---|---|
| 1,172,197 | A | 2/1916 | Cook | |
| 2,657,716 | A | 11/1953 | Ford | |
| 3,422,458 | A | 1/1969 | Shueller | |
| 3,930,667 | A * | 1/1976 | Osuchowski et al. | 280/730.1 |
| 4,089,065 | A * | 5/1978 | McGee | 2/456 |
| 4,300,894 | A | 11/1981 | Cumming et al. | |
| 4,397,046 | A * | 8/1983 | Steiner | 2/44 |

(Continued)

FOREIGN PATENT DOCUMENTS

| | | |
|---|---|---|
| CH | 697172 | 6/2008 |
| DE | 2258852 | 6/1974 |

(Continued)

OTHER PUBLICATIONS

International Search Report of PCT Application PCT/JP2007/059170 (published as WO 2007138817) filed on Apr. 27, 2007 in the name of Takata Corporation.

(Continued)

*Primary Examiner* — Katherine Moran
(74) *Attorney, Agent, or Firm* — Steinfl & Bruno, LLP

(57) ABSTRACT

A garment comprising a portion suitable for being combined with an inflatable member for protecting a user is described. The portion of the garment includes a covering surface suitable for forming a covering for the inflatable member. The covering surface comprises at least one insert made of elastic material.

14 Claims, 25 Drawing Sheets

(56) References Cited

U.S. PATENT DOCUMENTS

| | | | |
|---|---|---|---|
| 4,409,271 | A | 10/1983 | Pehr |
| 4,507,801 | A | 4/1985 | Kavanagh et al. |
| 4,737,994 | A | 4/1988 | Galton |
| 4,887,842 | A | 12/1989 | Sato |
| 4,977,623 | A | 12/1990 | DeMarco |
| 5,078,423 | A | 1/1992 | Fujita |
| 5,083,361 | A | 1/1992 | Rudy |
| 5,500,952 | A | 3/1996 | Keyes |
| 5,552,205 | A | 9/1996 | Lea |
| 5,781,936 | A | 7/1998 | Alaloof |
| 5,937,447 | A | 8/1999 | Howell |
| 5,941,866 | A | 8/1999 | Niedospial, Jr. |
| 5,945,359 | A | 8/1999 | Graham |
| 6,032,299 | A | 3/2000 | Welsh |
| 6,152,481 | A | 11/2000 | Arnold et al. |
| 6,239,046 | B1 | 5/2001 | Veiga et al. |
| 6,301,714 | B1 | 10/2001 | Son |
| 6,350,709 | B1 | 2/2002 | Veiga |
| 6,422,597 | B1 | 7/2002 | Pinsenschaum |
| 6,585,293 | B2 | 7/2003 | Keshavaraj |
| 6,734,125 | B2 | 5/2004 | Veiga |
| 6,753,275 | B2 | 6/2004 | Veiga |
| 6,770,578 | B2 | 8/2004 | Veiga |
| 7,254,853 | B1 | 8/2007 | Kim |
| 7,651,118 | B1 | 1/2010 | Veiga |
| 7,971,899 | B2 | 7/2011 | Abney et al. |
| 2002/0078484 | A1 | 6/2002 | Ulert |
| 2002/0140218 | A1 | 10/2002 | Beasley |
| 2002/0145276 | A1 | 10/2002 | Veiga |
| 2003/0146614 | A1 | 8/2003 | Zarazua |
| 2003/0150401 | A1 | 8/2003 | Schmid et al. |
| 2004/0029468 | A1 | 2/2004 | Kim et al. |
| 2004/0061316 | A1 | 4/2004 | Elaqadah et al. |
| 2004/0211085 | A1 | 10/2004 | Passke et al. |
| 2005/0098995 | A1 | 5/2005 | Fischer |
| 2006/0175810 | A1 | 8/2006 | Goto |
| 2006/0248632 | A1 | 11/2006 | Colombo |
| 2006/0292950 | A1 | 12/2006 | Hill |
| 2007/0040368 | A1 | 2/2007 | Manley |
| 2008/0000029 | A1 | 1/2008 | Feingold et al. |
| 2008/0169631 | A1 | 7/2008 | Hill |
| 2012/0011642 | A1 | 1/2012 | Dainese et al. |
| 2012/0032422 | A1 | 2/2012 | Dainese et al. |

FOREIGN PATENT DOCUMENTS

| | | |
|---|---|---|
| DE | 2626765 | 6/1976 |
| DE | 7837841 | 2/1982 |
| DE | 8620408 | 11/1986 |
| DE | 3903216 | 8/1990 |
| DE | 4007862 | 9/1990 |
| DE | 19640658 | 4/1998 |
| DE | 19732211 | 1/1999 |
| DE | 19928784 | 12/1999 |
| DE | 20003097 | 8/2000 |
| DE | 20021066 | 5/2001 |
| DE | 10141437 | 2/2003 |
| EP | 0051254 | 10/1981 |
| EP | 0043990 | 1/1982 |
| EP | 0943499 | 9/1999 |
| EP | 0994207 | 4/2000 |
| EP | 1749705 | 2/2007 |
| EP | 1767108 | 3/2007 |
| EP | 1852151 | 11/2007 |
| FR | 2674761 | 9/1992 |
| FR | 2677856 | 12/1992 |
| FR | 282028 | 9/2002 |
| FR | 2895645 | 7/2007 |
| GB | 2229680 | 10/1990 |
| GB | 2243119 | 10/1991 |
| GB | 2251368 | 7/1992 |
| GB | 2252083 | 7/1992 |
| GB | 2302642 | 1/1997 |
| GB | 2352162 | 1/2001 |
| GB | 2391840 | 2/2004 |
| IT | 2008A0000095 | 12/2008 |
| IT | 2009A000212 | 12/2009 |
| IT | 2010A000114 | 5/2010 |
| IT | 2010A000192 | 10/2010 |
| WO | 0123183 | 4/2001 |
| WO | 2005074861 | 8/2005 |
| WO | 2005094620 | 10/2005 |
| WO | 2006/000248 | 1/2006 |
| WO | 2006020593 | 2/2006 |
| WO | 2007022147 | 2/2007 |
| WO | 2007138817 | 12/2007 |
| WO | 2008044222 | 4/2008 |
| WO | 2009143000 | 11/2009 |
| WO | 2010112218 | 10/2010 |

OTHER PUBLICATIONS

EPO Search Report of Italian Application VE2008A0000095 filed on Dec. 31, 2008 in the name of RG Equipe Di Golin Roberto & C. S.A.S.

Written Opinion of Italian Application VE2008A0000095 filed on Dec. 31, 2008 in the name of RG Equipe Di Golin Roberto & C. S.A.S.

EPO Search Report of Italian Application VR2009A000039 filed on Mar. 25, 2009 in the name of Dainese, S.P.A.

Written Opinion of Italian Application VR2009A000039 filed on Mar. 25, 2009 in the name of Dainese, S.P.A.

EPO Search Report of Italian Application VR2009A000212 filed on Dec. 4, 2009 in the name of Dainese S.P.A.

Written Opinion of Italian Application VR2009A000212 filed on Dec. 4, 2009 in the name of Dainese S.P.A.

EPO Search Report of Italian Application VR2010A000114 filed on May 28, 2010 in the name of Dainese S.P.A.

Written Opinion of Italian Application VR2010A000114 filed on May 28, 2010 in the name of Dainese S.P.A.

EPO Search Report of Italian Application VR2010A000192 filed on Oct. 5, 2010 in the name of Dainese S.P.A.

Written Opinion of Italian Application VR2010A000192 filed on Oct. 5, 2010 in the name of Dainese S.P.A.

International Search Report of PCT Application PCT/IB2009/055507 filed on Dec. 4, 2009 in the name of Dainese S.P.A.

Written Opinion of PCT Application PCT/IB2009/055507 filed on Dec. 4, 2009 in the name of Dainese S.P.A.

International Search Report of PCT Application PCT/IB2009/055512 filed on Dec. 4, 2009 in the name of Dainese S.P.A.

Written Opinion of PCT Application PCT/IB2009/055512 filed on Dec. 4, 2009 in the name of Dainese S.P.A.

International Search Report of PCT Application PCT/IT2009/000547 filed on Dec. 4, 2009 in the name of Dainese S.P.A.

Written Opinion of PCT Application PCT/IT2009/000547 filed on Dec. 4, 2009 in the name of Dainese S.P.A.

Partial International Search Report of PCT Application PCT/IB2009/055516 filed on Dec. 4, 2009 in the name of Dainese S.P.A.

International Search Report of PCT Application PCT/IB2009/055516 filed on Dec. 4, 2009 in the name of Dainese S.P.A.

Written Opinion of PCT Application PCT/IB2009/055516 filed on Dec. 4, 2009 in the name of Dainese S.P.A.

EPO Search Report of Italian Application RM2008A000656 filed on Dec. 9, 2008 in the name of Dainese S.P.A.

Written Opinion of Italian Application RM2008A000656 filed on Dec. 9, 2008 in the name of Dainese S.P.A.

EPO Search Report of Italian Application RM2008A000657 filed on Dec. 9, 2008 in the name of Dainese S.P.A.

Written Opinion of Italian Application RM2008A000657 filed on Dec. 9, 2008 in the name of Dainese S.P.A.

EPO Search Report of Italian Application VR2009A000078 filed on May 29, 2009 in the name of Dainese S.P.A.

Written Opinion of Italian Application VR2009A000078 filed on May 29, 2009 in the name of Dainese S.P.A.

EPO Search Report of Italian Application VR2009A000059 filed on Apr. 24, 2009 in the name of Dainese S.P.A.

Written Opinion of Italian Application VR2009A000059 filed on Apr. 24, 2009 in the name of Dainese S.P.A.

(56) References Cited

OTHER PUBLICATIONS

Notice of Opposition issued for EP Application No. EP09775309.9 filed on Dec. 4, 2009 in the name of Dainese S.p.A.

Reply to the Notice of Opposition filed on Jun. 21, 2013 for EP Application No. EP09775309.9 filed on Dec. 4, 2009 in the name of Dainese S.p.A.

Notice of Opposition issued for EP Application No. EP2373189 filed Dec. 4, 2009 in the name of Dainese S.p.A.

Restriction Requirement issued for U.S. Appl. No. 13/133,437, filed Sep. 21, 2011 and mailed on Jan. 4, 2013.

Non-Final Office Action issued for U.S. Appl. No. 13/133,437, filed Sep. 21, 2011 and mailed on Mar. 5, 2013.

Restriction Requirement issued for U.S. Appl. No. 13/133,524, filed Sep. 23, 2011 and mailed on Dec. 6, 2012.

Non-Final Office Action issued for U.S. Appl. No. 13/133,524, filed Sep. 23, 2011 and mailed on Apr. 2, 2013.

Superficial Definition, Merriam-Webster's Online Dictionary, available at, http://www.merriam-webster.com/dictionary/superficial (last visited on Feb. 25, 2013).

Mesh Definition, Merriam-Webster's Online Dictionary, available at, http://www.merriam-webster.com/dictionary/mesh (last visited on Feb. 26, 2013).

Weave Definition, Merriam-Webster's Online Dictionary, available at, http://www.merriam-webster.com/dictionary/weave (last visited on Feb. 28, 2013).

Woven Definition, Merriam-Webster's Online Dictionary, available at, http://www.merriam-webster.com/dictionary/woven (last visited on Feb. 28, 2013).

Side curtain Airbag Volkswagen Touran Images. Nov. 24, 2006.

PCT International Search Report mailed on Oct. 10, 2012 for PCT/IB2012/053302 filed on Jun. 28, 2012 in the name of Dainese S.P.A.

PCT International Preliminary Report on Patentability completed on Jun. 10, 2013 for PCT/IB2012/053302 filed on Jun. 28, 2012 in the name of Dainese S.P.A.

PCT Written Opinion mailed on Oct. 10, 2012 for PCT/IB2012/053302 filed on Jun. 28, 2012 in the name of Dainese S.P.A.

Final Office Action mailed on Aug. 19, 2013 for U.S. Appl. No. 13/133,524, filed Sep. 23, 2011 in the name of Lino Dainese et al.

Notice of Allowance mailed on Aug. 21, 2013 for U.S. Appl. No. 13/133,437, filed Sep. 21, 2011 in the name of Lino Dainese et al.

Non-Final Office Action mailed on Feb. 19, 2014 for U.S. Appl. No. 13/133,524, filed Sep. 23, 2011 in the name of Lino Dainese et al.

* cited by examiner

GARMENT ADAPTED TO BE ASSOCIATED TO A DEVICE FOR THE PERSONAL PROTECTION OF A USER

CROSS REFERENCE TO RELATED APPLICATIONS

The present application is the US national stage of International Application PCT/IB2009/055516 filed on Dec. 4, 2009, which claims priority to Italian patent application RM2008A000656 filed on Dec. 9, 2008, to Italian patent application RM2008A000657 filed on Dec. 9, 2008, to Italian patent application VR2009A000039 filed on Mar. 25, 2009 and to Italian patent application VR2009A000059 filed on Apr. 24, 2009. The present application may be related to International Applications PCT/IB2009/055512, filed on Dec. 4, 2009; PCT/IT2009/000547, filed on Dec. 4, 2009; and PCT/IB2009/055507, filed on Dec. 4, 2009.

The present disclosure relates to a garment suitable for use with a protection device for personal protection, which device is able to protect a passenger, a motorcycle rider or a similar user from impacts and/or falls during a sporting and/or working activity.

In recent years, following constant research into safety during all sporting activities, but more generally during all those dangerous activities which are performed in extreme conditions or at high speeds, garments suitable for use with a personal protection device for a user have been devised.

In particular, the motorcycling sector has paid considerable attention to such problems and in recent years an increasing number of garments which include such a protection device able to provide effective and at the same time comfortable protection for the motorcyclist or rider have been proposed.

A convenient solution is for example that of combining an inflatable member, such as a bag made of airtight material, with a garment portion in parts of the body which are potentially subject to impacts. Basically the inflatable member is arranged deflated and folded underneath said garment portion so that the latter acts as a covering surface for the inflatable member.

The inflatable member is moreover placed in fluid communication, at the moment of an impact, during sliding or generally during a fall, with a compressed-gas source, such as a gas canister. Generally the gas source is able to introduce into the inflatable element a predefined quantity of compressed gas such as to produce the inflated and therefore tensioned condition of the inflatable member, forming an inflated and round-shaped, for example balloon-like casing.

In particular the inflatable element in the inflated condition projects from the garment portion and from the covering surface through an opening suitably provided or a flap which can be opened.

The garments according to the prior art have, however, not proved to be sufficiently effective and practical in terms of use and protection of the rider, in particular when used in motorcycling racing competitions.

It has in fact been found that the presence of inflatable members often makes a garment rigid in the zone where the inflatable element is applied and prevents, or at least hinders, the movements of a rider in the riding position.

Moreover, frequently, in motorcycling races, the riders, even after a serious fall, manage to get up and continue the race.

Consequently the inflatable members must not only inflate sufficiently rapidly in the event of a fall or the like in order to protect the parts of the body which are potentially subject to the impacts, but must also be easily deflatable after a fall or accidental inflation in order to allow the rider to continue the race.

Basically there has arisen the need to have garments in which the inflatable members occupy a minimum amount of space for the rider, also when the rider continues racing following a fall, so as to reduce to a minimum the obstacle to movements and also so as not to adversely affect the aerodynamics during riding. There has also arisen the need to be able to reposition the inflatable element also once deflated in a position which occupies a minimum amount of space so that it does not hinder the rider.

The technical problem underlying the present disclosure is that of providing a garment which is able to overcome the abovementioned drawbacks of the prior art, of satisfying one and/or the other of said abovementioned requirements and/or of achieving further advantages.

This problem is solved by a garment, as defined in the claims.

Secondary characteristics of the subject of the present disclosure are defined in the corresponding dependent claims.

Basically, according to the present disclosure, a portion of the garment forms a covering for the inflatable member. This covering includes an insert made of elastic material. The insert is fixed, for example stitched, to a remaining portion of the garment.

The subject of the present disclosure provides a number of significant advantages.

The main advantage of the garment according to the present disclosure consists in the fact that the covering surface intended to cover the inflatable member includes an elastic insert (namely, the elastic insert occupies a part of the covering surface and, once inserted, creates a superficial discontinuity which is preferably formed by material in the covering surface). Moreover, the insert allows the garment portion to adapt to the inflation of the inflatable member and is also able to favour the return of the inflatable member into the deflated condition; this is possible owing to the typical properties of the elastic material which, once deformed by a deforming action (in the present case resulting from the inflation of the inflatable member) resumes its normal or initial configuration when the deforming action ceases.

In fact, in the garment according to the present disclosure, when the inflatable member is inflated, the insert is in a completely deformed condition and increases in fact the overall extension of the covering surface, whereas when the inflatable member is in the deflated condition, the elastic member returns into an undeformed or only partially undeformed condition and brings the covering surface back into its initial extended condition.

In this way, when the inflatable member is deflated, the insert returns into its original undeformed or partially deformed condition, taking with it the part of the garment to which it is fixed.

Therefore, the elastic insert allows the garment portion to adapt to the change in volume of the inflatable member and helps the deflating action and therefore the inflatable member to return into the deflated position.

In other words, according to the present disclosure, the covering surface covers constantly the inflatable member both when it is in the inflated condition (there are therefore no openings in the garment portion or in the covering surface which allow the inflatable member to protrude in the inflated condition) and when it is in the deflated condition, and the garment portion is drawn along by the elastic insert during inflation/deflation of the inflatable member. During inflation the volume of the inflatable member expands owing to the pressure of a pressurized gas and therefore causes deformation of the elastic insert; when the inflatable member is deflated the elastic insert, owing to its elastic properties, recovers its initial form and thus draws along with it the covering surface, keeping the inflatable member pressed and compressed against the user's body and expelling the gas from the inflatable member.

This therefore favours close fitting of the garment to the motorcyclist's body whilst riding, increasing the aerodynamic form thereof, also following an inflation/deflation cycle of the inflatable member.

Preferably, the covering surface is mainly made of an inextensible material.

In one embodiment the covering surface is mainly made of leather.

Preferably, the inflatable member therefore remains completely hidden underneath the garment portion, in particular underneath the covering surface, both in the deflated condition and in the inflated condition.

Preferably, in the undeformed condition, the insert is substantially flat, flush as or coplanar with the part of the covering portion adjacent thereto. In fact, in the garment according to the present disclosure, when the inflatable member is in an undeformed or only partly undeformed condition, the insert does not form preferably zones projecting from the remainder of the covering portion, so that the inflatable member is not visible from the exterior.

In one embodiment, the covering surface includes an additional layer for protection against abrasion, for example made of mainly inextensible material (for example leather) or a material having a limited elasticity compared to the elastic insert. The additional layer covers at least partly the elastic insert and is superimposed thereon. Preferably, the elastic insert has a superficial extension greater than that of the additional layer and the additional layer is superimposed on the elastic insert so that one peripheral edge or hem of the elastic insert surrounds the additional layer. The peripheral hem of the elastic insert is fixed to the remainder of the garment portion.

This embodiment has the advantage that, in the case of a motorcyclist's jacket and/or riding suit made mainly of leather or material similar to leather, the additional layer ensures a high degree of protection against abrasion for a motorcyclist similar to that of leather also in the region of the elastic insert. Basically, the peripheral hem of the insert made of elastic material occupies a minimum part of the garment portion and allows the garment to preserve the protective characteristics provided by the leather or the leather-like material.

In an alternative embodiment, the entire insert made of elastic material is visible from the exterior, namely the covering surface consists only of said elastic insert. Preferably, the insert made of elastic material is made of a suitable material which is sufficiently resistant, also to tearing, such as elastic KEVLAR® (a synthetic fiber).

Preferably, it consists of an anisotropic elastic fabric.

In one embodiment the elastic insert is arranged in the region of the neck and in the region of the shoulders. This arrangement favours the movements of the user, in particular of a motorcyclist, in these zones.

In fact, a motorcyclist in the typical racing position, namely seated on the motorcycle with the trunk of the body hunched and inclined forwards, has his/her arms extending forwards and bent, this producing a tension in the garment in the rear region of the shoulders. Basically, the presence of an elastic insert in the region of the neck and in the region of the shoulders improves the comfort and the fit of this garment portion, allowing this garment portion to adapt to the rider's movements.

A further advantage due to the presence of the elastic insert consists generally in greater comfort and a better fit of the garment for the user.

In particular, according to the present disclosure, the presence of an elastic insert compensates for any rigidity resulting from the presence of the inflatable member situated underneath the garment portion and the covering surface.

Preferably, in the case, as already mentioned, of a motorcyclist's riding suit or jacket, the garment includes an aerodynamic appendage situated on the back, and a corresponding part of the inflatable member is preferably covered by the aerodynamic appendage. Basically, the aerodynamic appendage forms a covering surface for a part of the inflatable member arranged along the user's spine.

In one embodiment the garment comprises a further insert made of elastic material and formed by an elasticized strip which extends over a region of the user's back from one armpit zone to the other armpit zone. This elasticized strip allows the garment to adapt further to the expansion of the inflatable member, and its return into the deflated condition.

Preferably, the elasticized strip comprises two oblique sections, which extend substantially from a respective armpit zone towards a region of the user's neck, and a substantially horizontal section which connects these oblique sections.

In the case of a motorcyclist's riding suit or jacket, the substantially horizontal section extends above the aforementioned aerodynamic appendage.

Even more preferably, the elasticized strip includes a first corrugated layer made of leather or other inextensible material and a second layer made of elastic fabric; the first layer includes an alternating series of humps and grooves and is fixed to the second layer by means of stitching in the region of the grooves. This corrugated multilayer structure ensures, at the same time, a high degree of protection, provided by the leather, and a satisfactory degree of deformability, provided by the elastic fabric.

In one embodiment, in order to control in an optimum manner the expansion of the inflatable member and allow the inflatable member to be retained within the garment, means are provided for controlling the form of the inflatable member. In particular, the inflatable member includes a plurality of tie members, preferably thread-like in nature, which are situated inside the inflatable member and are stably associated with surface portions of the said inflatable member.

In the present disclosure, "tie member" is understood as meaning a member or part which has the function of keeping joined or fastened together or immobile two or more parts of the inflatable member, at least when the latter is in the inflated condition, said tie member being tensioned by a tensile force when the inflatable member is in the inflated condition.

The tie members have dimensions such that, when the inflatable member is in the deflated rest condition, the tie members are in an untensioned condition collapsed inside the inflatable member, whereas when the inflatable member is in the inflated condition, the tie members are subject to the tensile force. By suitably defining the maximum length of the tie members in the taut or tensioned condition it is possible to control a priori the form of the inflatable member in the inflated condition.

In one embodiment, the insert made of elastic material has a strip or band-like form. This embodiment has the advantage that the elastic insert occupies only partially—and therefore only a small part of—the garment portion. In this way, the garment portion may be made of a fabric or a material suitable for the use made of the garment—for example leather or a leather-like material in the case of a motorcyclist's jacket and/or riding suit—namely of an inextensible material. In this case, the leather ensures a high degree of protection for a motorcyclist.

Consequently, the strip of elastic material, preferably elastic fabric, by occupying a minimum part of the garment portion, is able to help preserve the protective properties provided by the leather or leather-like material.

In a preferred embodiment, in order to increase the above-mentioned advantage of helping repositioning of the inflatable member in the deflated condition, the insert made of elastic material occupies a perimetral zone of the covering surface and therefore a perimetral zone of the inflatable member. Basically, the insert made of elastic material surrounds at least partially the inflatable member when the latter is combined with the garment.

Even more preferably, the insert made of elastic material has the form of a closed loop and is situated around, at least partially, the inflatable member when the latter is combined with the garment. In this way, the entire covering surface of the garment is drawn along in a uniform manner by the insert made of elastic material.

In one embodiment, the covering surface (and correspondingly also the inflatable member) includes a first part which is substantially C-shaped and intended to be positioned around a zone of the neck and partially a zone of the chest of the user.

In this embodiment, preferably, the insert made of elastic material includes a first section which is substantially C-shaped and positioned in the perimetral zone of said first part of the covering surface.

Even more preferably, the covering surface (and correspondingly also the inflatable member) includes a second part having an elongated form and intended to be positioned along a region which extends in the articulation region of one shoulder, or preferably both shoulders, of the user.

In this embodiment, preferably, the insert made of elastic material includes a second section which is positioned in a perimetral zone of said second part of the covering surface, said second section extending around the articulation region of the user's shoulder, extending from a front region on the chest and passing into a region of the upper arm and reaching a rear zone in the neck region of the user. It should be noted that the presence of an elastic insert which extends as mentioned from the neck region to the shoulder region favours the movements of a user, in particular of a motorcyclist, in these regions.

In fact, a motorcyclist in the typical racing position, namely seated on the motorcycle with the trunk hunched and inclined forwards, has his/her arms extending forwards and bent, this producing a tension in the garment in the rear region of the shoulders.

Preferably, the inflatable member includes a third part arranged opposite the user's spine.

Preferably, in the case, as already mentioned, of a motorcyclist's riding suit or jacket, the garment includes an aerodynamic appendage which is situated on the back, and this third part of the inflatable member is preferably covered by the aerodynamic appendage. Basically, the aerodynamic appendage forms a covering surface for the third part of the inflatable member.

In an alternative embodiment, a garment according to the present disclosure comprises a pocket which is made at least partly of elastic material and is intended to house a protection device. The protection device comprises an inflatable member which defines internally an internal chamber inside which a plurality of tie members are distributed and stably connected to respective surface portions of the inflatable member.

This embodiment offers advantages similar to those of the embodiments previously described since the pocket is made at least partly of elastic material and therefore adapts to the inflated and deflated form of the inflatable member.

In this embodiment, the pocket has preferably the form of a closed casing.

In one embodiment, the pocket is applied on top of a visible surface of the garment and therefore projects from the surface of the garment.

Other advantages, characteristic features and modes of use of the subject of the present disclosure will become clear from the following detailed description of a number of preferred embodiments thereof, provided by way of a non-limiting example. It is clear, however, how each embodiment may have one or more of the advantages listed above; in any case it is nevertheless not required that each embodiment should have simultaneously all the advantages listed.

Reference shall be made to the figures of the accompanying drawings in which.

Figure 2:
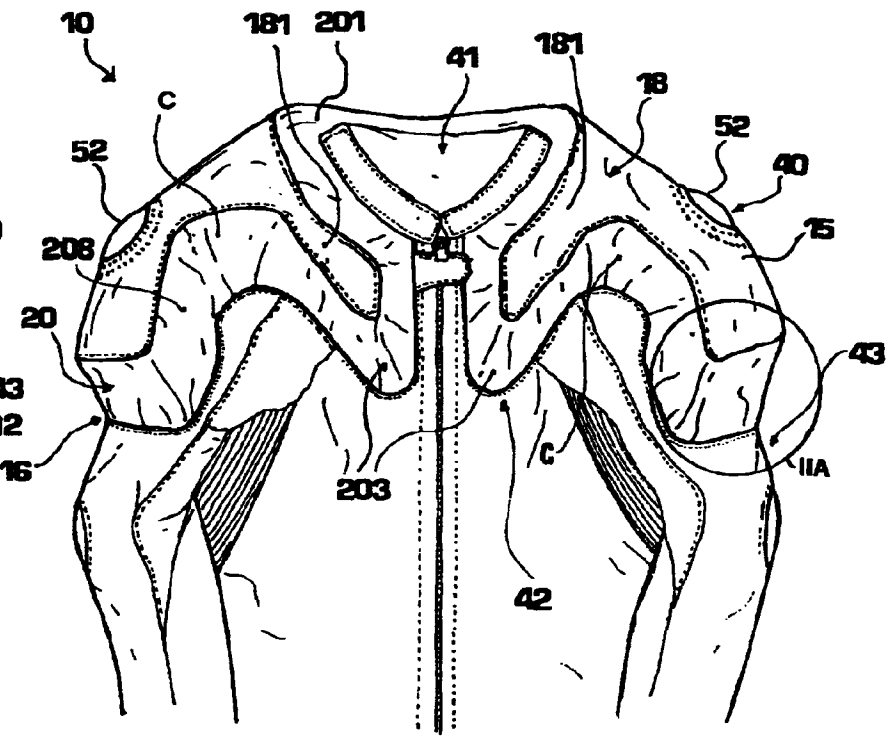
FIG. 2 shows a partial front view of the garment according to FIG. 1, in a second operating condition.
Figure 1:
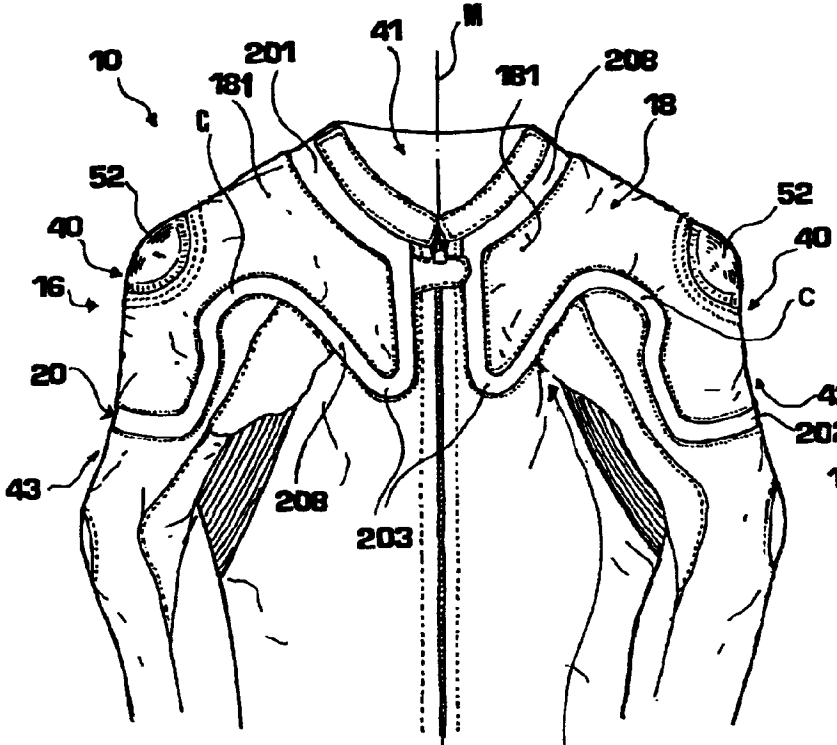
FIG. 1 shows a partial front view of a garment according to the present disclosure, in a first operating condition.

With reference to the accompanying FIGS. 1 to 12, the reference number 10 denotes a first embodiment of a garment, in the example a motorcyclist's riding suit, only the top part of which covering the trunk and arms is shown.

The garment 10 is combined with an inflatable member 12 for the protection of a user, said inflatable member 12 comprising in the example a flexible bag made of airtight material, such as polyamide, and suitable for assuming substantially a first rest condition or deflated condition and a second active operating condition or inflated condition. The modes for inflating the inflatable member 12 will be described in the remainder of the description.

As can be seen in particular in FIGS. 3 and 10 and as will be explained more fully below, the inflatable member 12 is positioned in a portion 16 of the garment 10, in the example in a portion which covers part of the upper body (region of the neck 41, region of the chest 42, region of the articulations of the shoulders 40), part of the back 45 and part of the arms (region of the upper arm 43) of the portion 16 of the garment 10.

Even more particularly, the inflatable member 12 is positioned hidden from view, in contact with an inner side 14 of the portion 16 of the garment 10. Therefore, said garment portion 16 forms, opposite the inflatable member 12, a covering surface 18 for the inflatable member 12. Namely, the portion 16 of the garment 10 includes a covering surface 18 which is positioned opposite the inflatable member 12 so as to cover/close entirely the latter.

Consequently, the covering surface 18 has a form and dimensions such as to cover the inflatable member 12.

Figure 3:
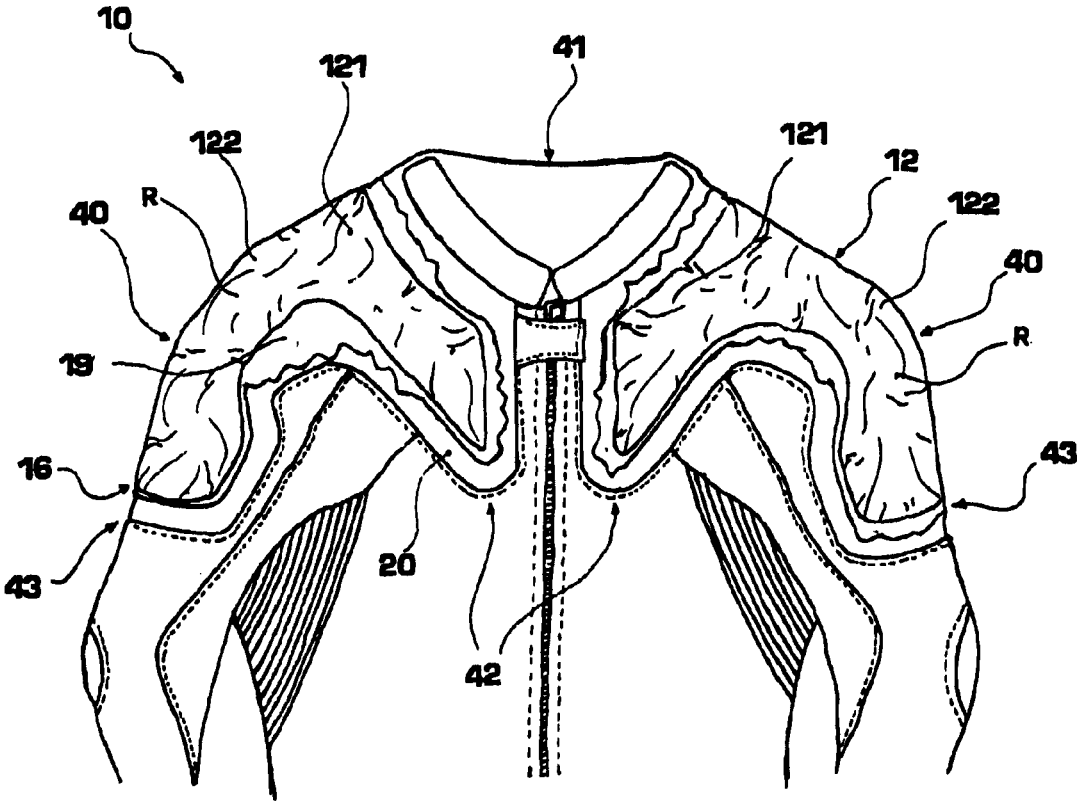
FIG. 3 shows a partial front view of the garment according to FIG. 1, partly cross-sectioned.
Figure 2A:
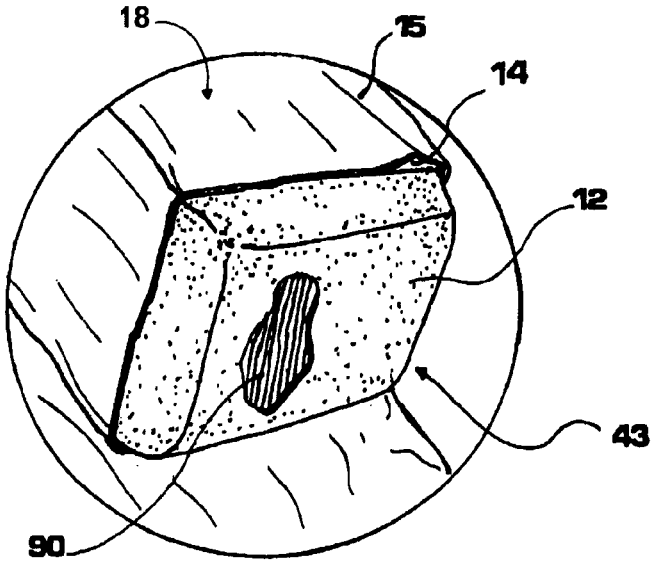
FIG. 2A shows a view of a detail IIA of FIG. 2, partly cross-sectioned and on a larger scale.
Figure 10:
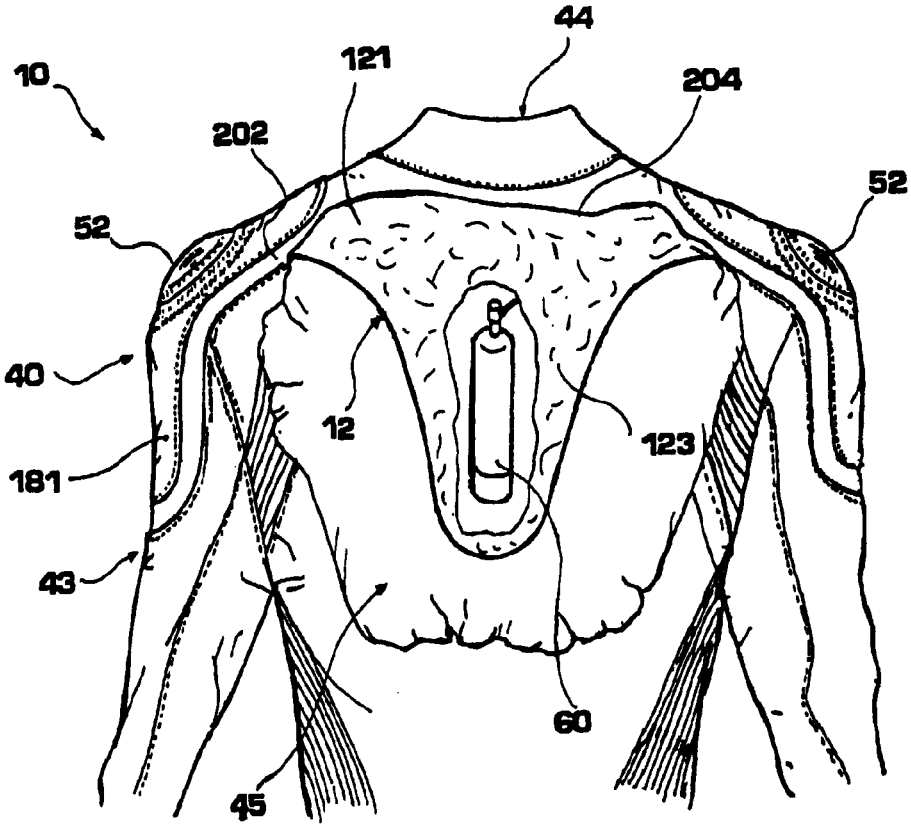
FIG. 10 shows a partial rear view of the garment according to FIG. 6, partly cross-sectioned.

In particular, the inflatable member 12 can be seen in the inflated condition in FIG. 2A, which shows the detail IIA of FIG. 2 cross-sectioned, and can also be seen in FIG. 3 and FIG. 10 in the deflated condition. In particular, in order to view the inflatable member 12, in FIG. 3 and FIG. 10, part of the covering surface 18 has been removed from the portion 16 of the garment 10.

Preferably, in the example shown the garment 10 also comprises an inner flap 19 (visible in FIG. 3 and FIG. 9) which forms, together with the covering surface 19, a housing 23 or inner pocket for the inflatable member 12. Basically, the inflatable member 12 is stably inserted between the inner flap 19 and the covering portion 18 (in particular its inner side 14).

The inner flap 19 is preferable made of comfort—preferably breathable—fabric.

The housing 23 has the advantage that it allows easily any replacement of the inflatable member 12.

Alternatively, in order to retain stably the inflatable member 12 underneath the covering surface 18, the garment 10 comprises stitches, hooks or other systems suitable for fixing the inflatable member 12 to the covering surface 18 or to the inner flap 19.

Basically, as mentioned above, the inflatable member 12 is positioned stably on the portion 16 of the garment 10 so that said portion 16 forms, on the outside, a covering or closure for the inflatable member by means of the covering surface 18. The inflatable member 12 therefore is not visible from the outside and is stably fixed inside the housing 23 or to the portion 16 of the garment 10, for example on the inner flap 19. The garment 10 also comprises an insert 20 made of elastic material and forming part of said covering surface 18 and intended to cover, together with the latter, the inflatable member 12. In the example, the insert 20 consists of anisotropic elastic fabric, even more particularly an elastic material which has a high tear strength, such as elastic KEVLAR® (a synthetic fiber).

In the example illustrated, the elastic insert 20, when the inflatable member 12 is in a deflated condition, is situated substantially coplanar or flush with the remainder of the garment portion 16 adjacent thereto.

The elastic insert 20 includes a first part, denoted by the reference numbers 201, 203, with a substantially C-shaped form and occupying a region of the neck 41 and partly a region of the chest 42 of the garment 10 and a second part, denoted by the reference numbers 202, 204, with an elongated form and occupying a zone which extends from an articulation region of one shoulder 40 to the articulation region of the other shoulder 40, passing via a back region 45.

More particularly, as can be seen in the Figures, the first part has a curved section 201 and two ends 203 which extend as far the chest region 42.

Even more particularly, the second part 202, 204 of the elastic insert 20 has a section 202 in an upper arm region 43, a rear section 204 in the region of the back of the neck 44 and also a section 202 in the other upper arm region 43. Basically, the second part 202, 204 of the elastic insert 20 extends from an upper arm region 43 passing via a rear zone in the region of the back of the neck 44 and reaching the other upper arm region 43.

Figure 5:
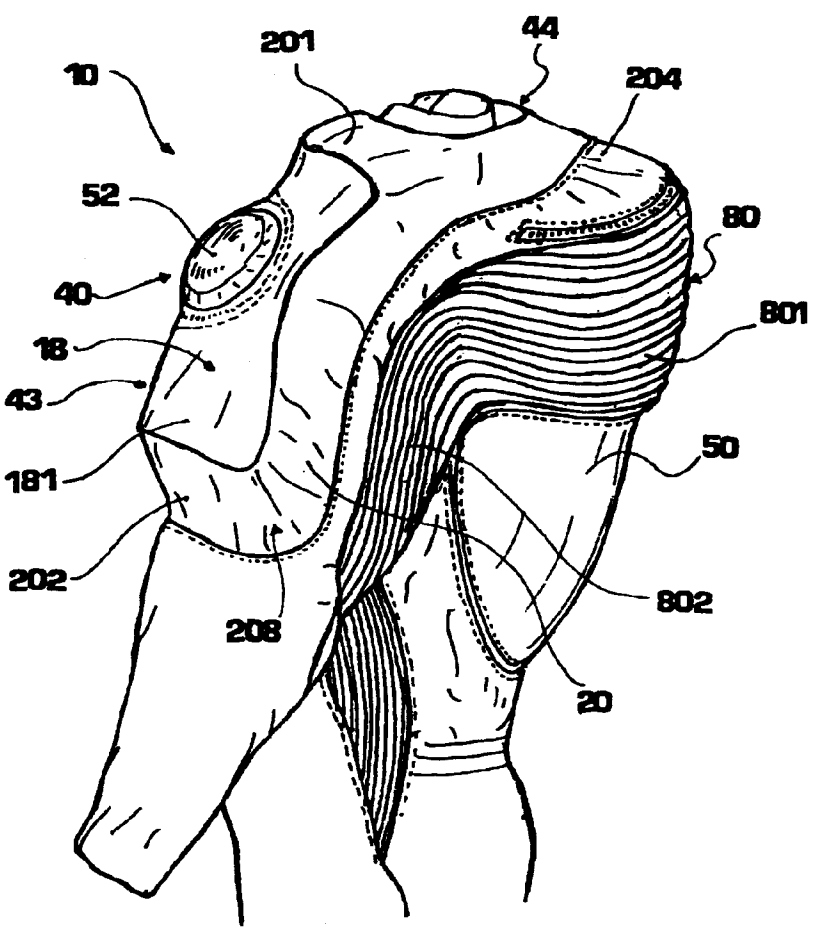
FIG. 5 shows a partial side view of the garment according to FIG. 1 in said second operating condition.
Figure 4:
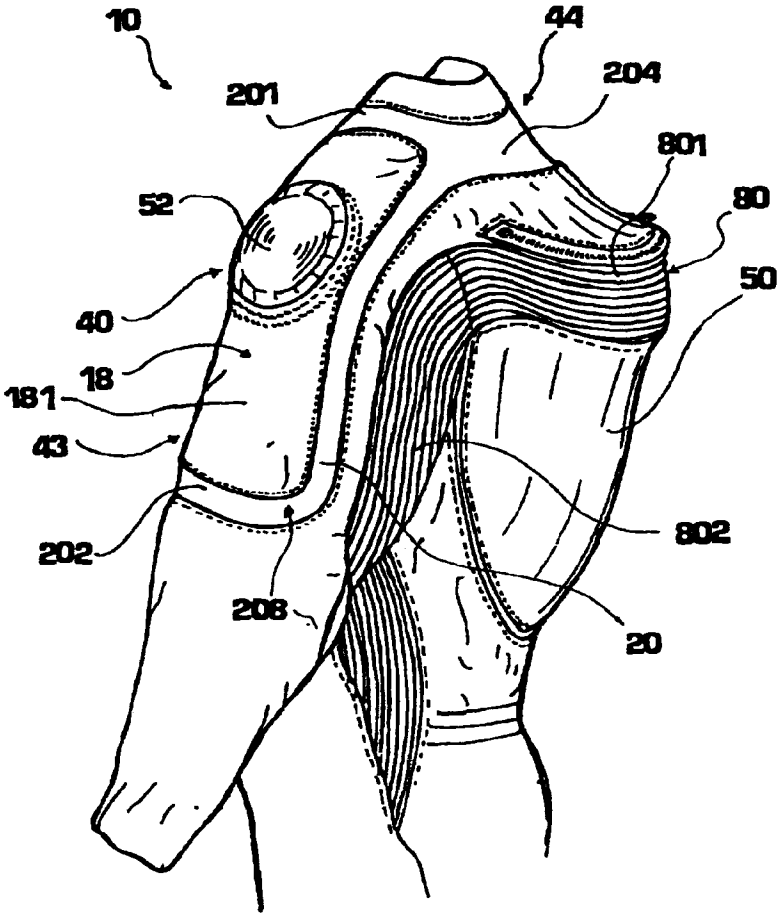
FIG. 4 shows a partial side view of the garment according to FIG. 1 in said first operating condition.
Figure 6:
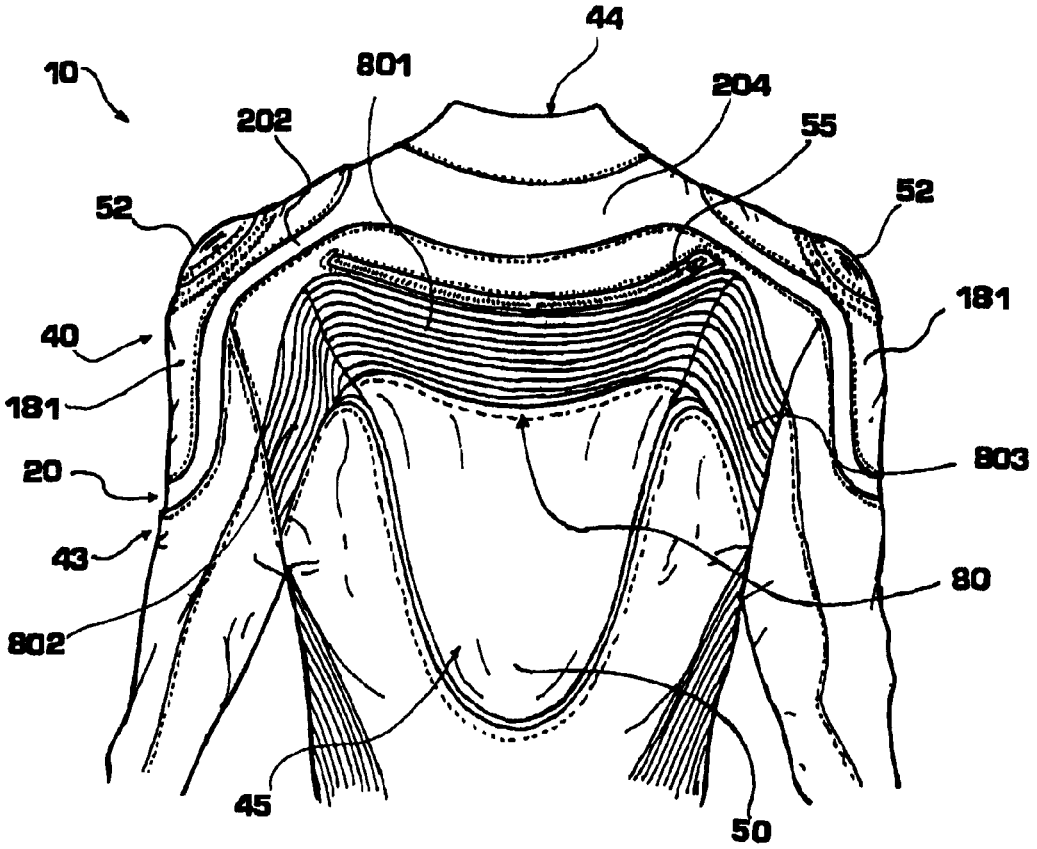
FIG. 6 shows a partial rear view of the garment according to FIG. 1.
Figure 7:
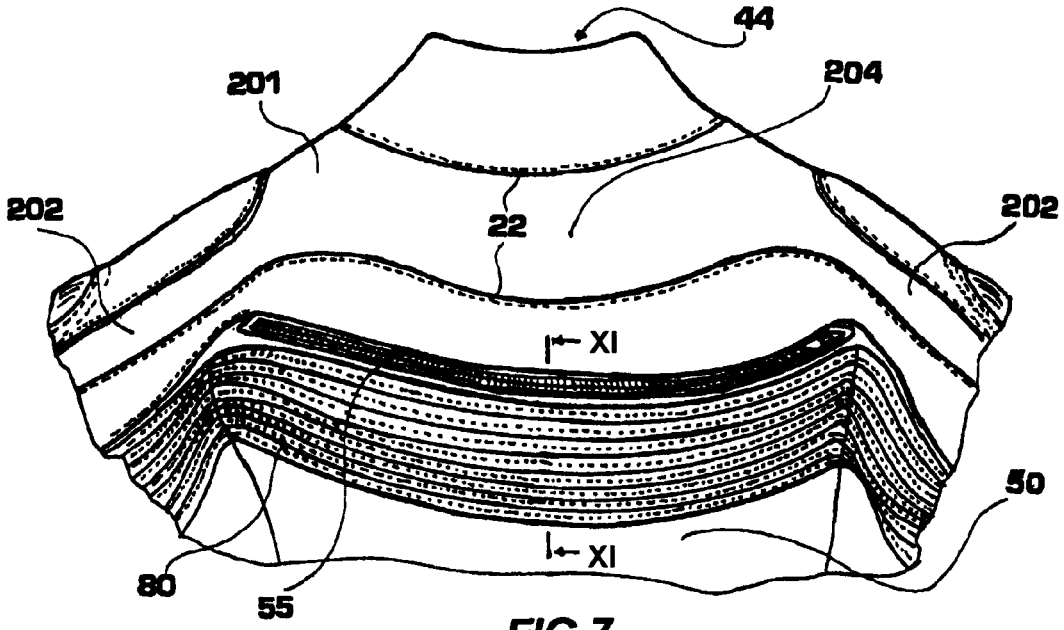
FIG. 7 shows a rear view of a detail on a larger scale of the garment according to FIG. 6.
Figure 8:
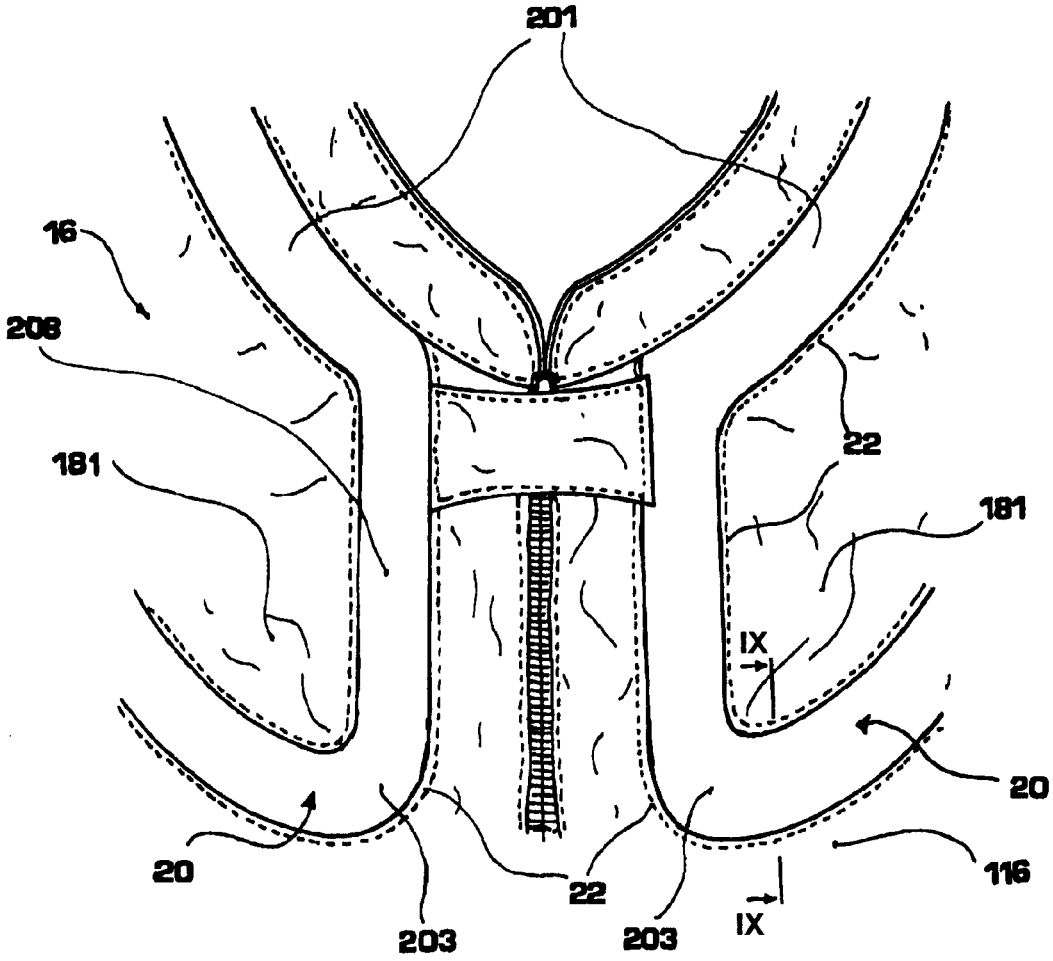
FIG. 8 shows a detail, on a larger scale, of the garment according to FIG. 1.
Figure 9:
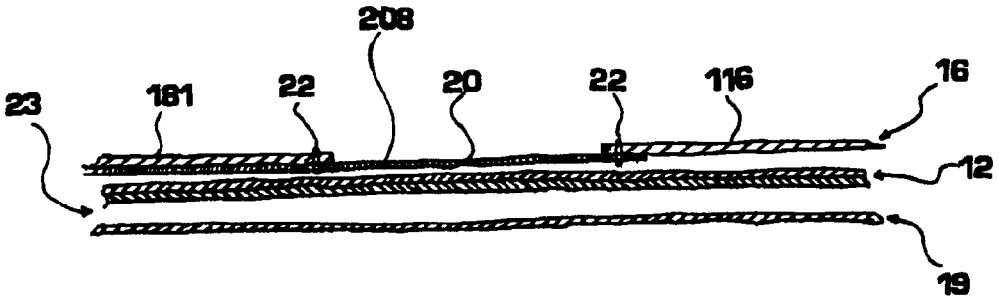
FIG. 9 show a cross-sectional view along the line IX-IX of the garment according to FIG. 8.
Figure 12:
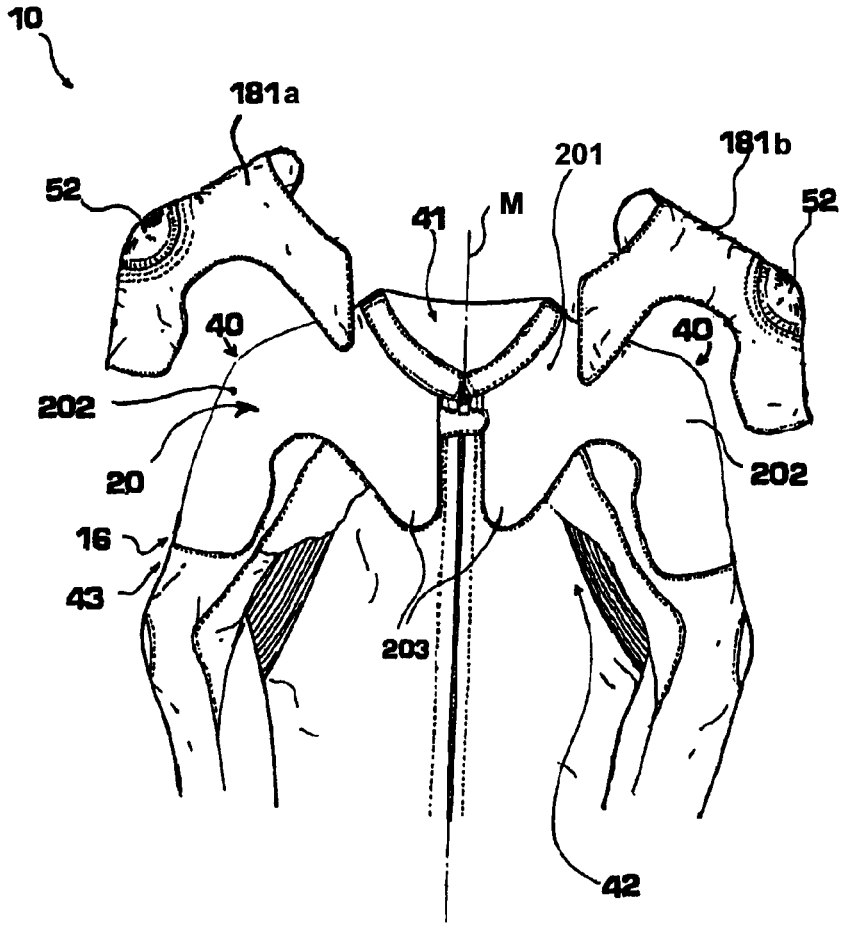
FIG. 12 shows a partial front view of the garment according to FIG. 1, with parts separated.
Figure 14:
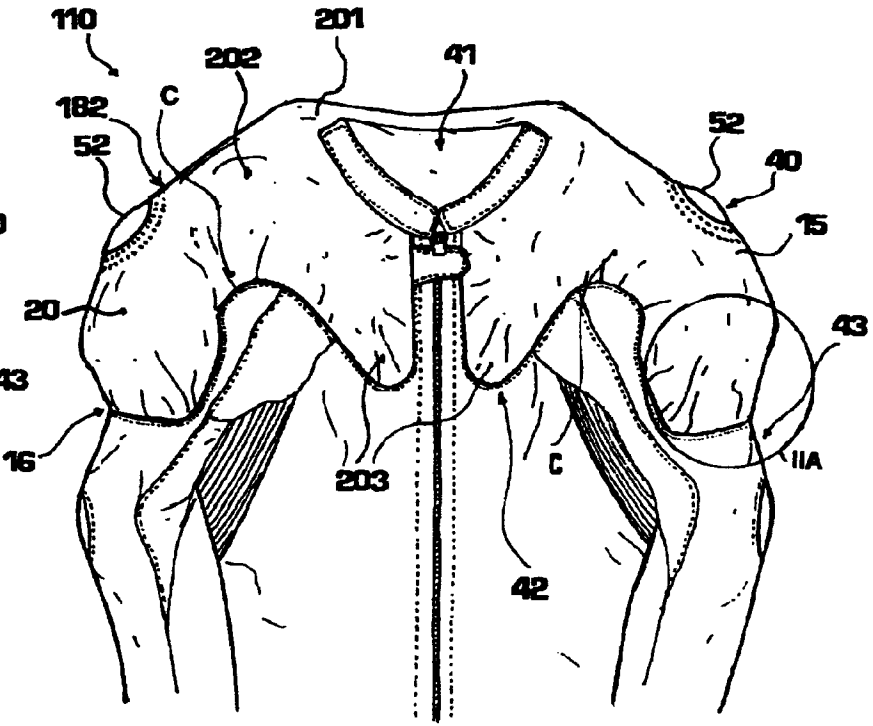
FIG. 14 shows a partial front view of the garment according to FIG. 13, in a second operating condition.
Figure 13:
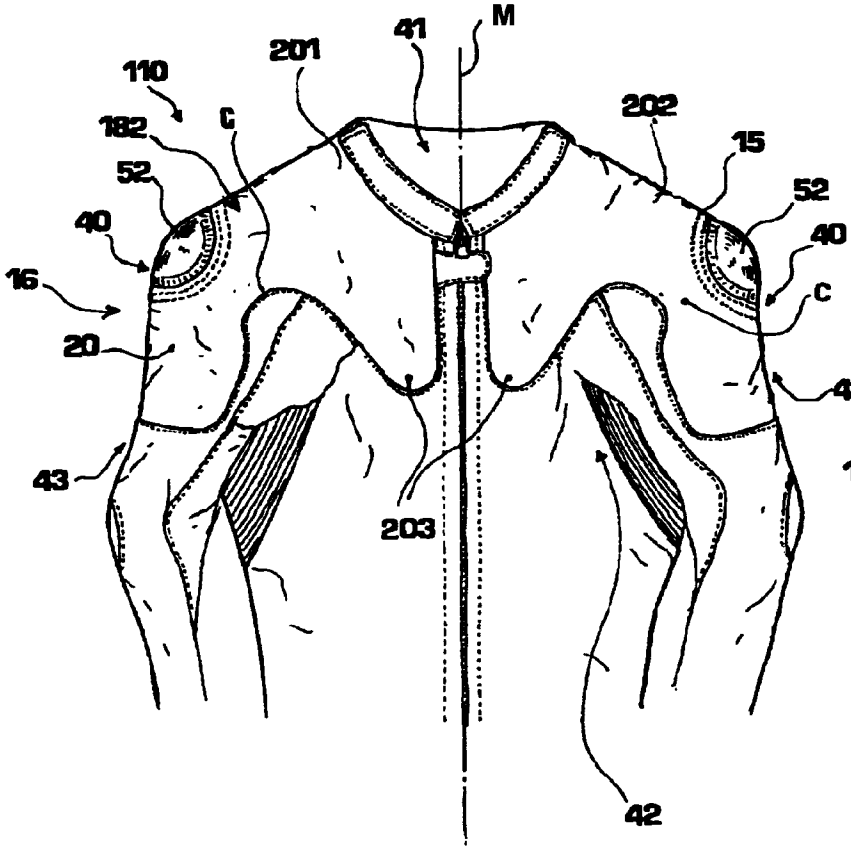
FIG. 13 shows a partial front view of a garment according to the present disclosure and in accordance with a variation of embodiment, in a first operating condition.
Figure 16:
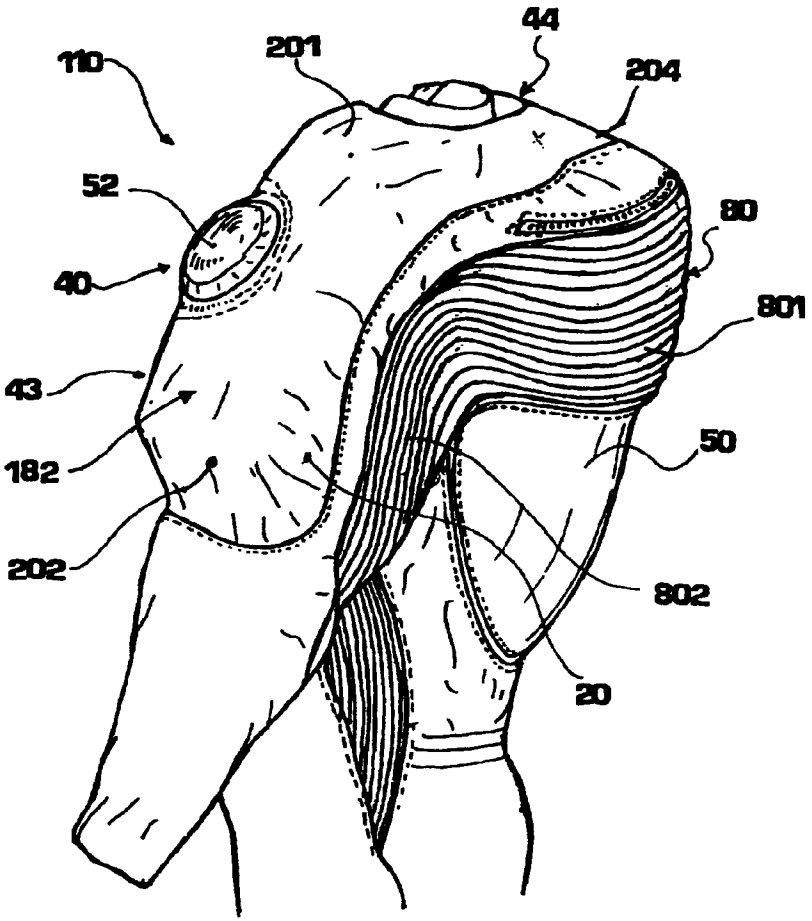
FIG. 16 shows a partial side view of the garment according to FIG. 13 in said second operating condition.
Figure 15:
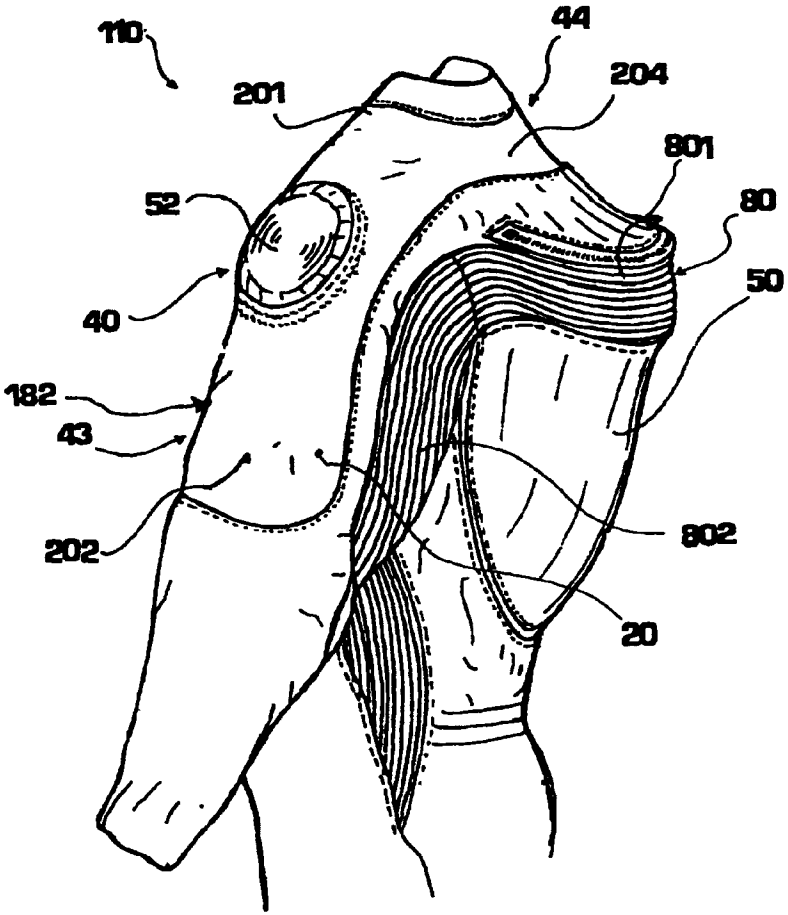
FIG. 15 shows a partial side view of the garment according to FIG. 13 in said first operating condition.
Figure 17:
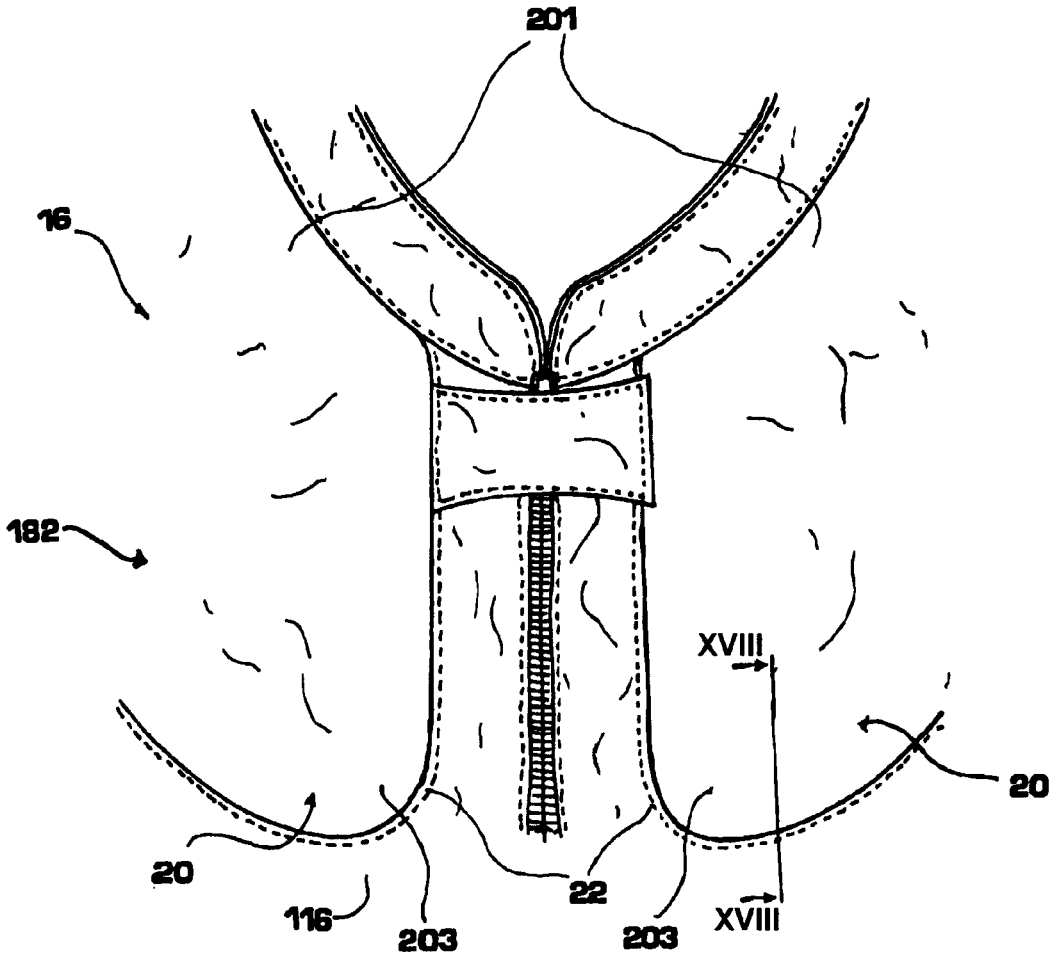
FIG. 17 shows a detail, on a larger scale, of the garment according to FIG. 13.
Figure 18:
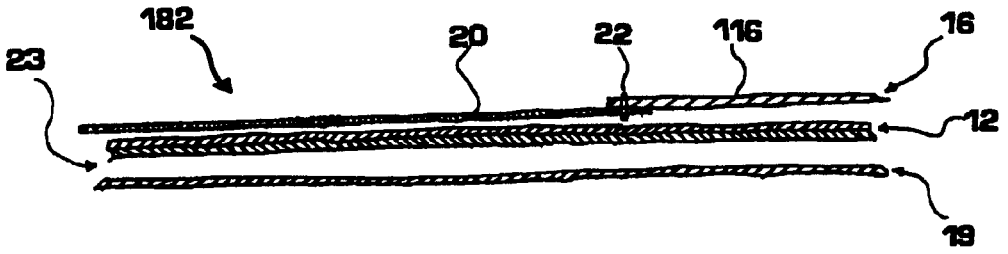
FIG. 18 shows a cross-sectional view along the line XVIII-XVIII of the garment according to FIG. 17.

As can be seen from FIGS. 4, 5 and 12, the first part 201, 203 and the second part 202, 204 of the elastic insert 20 are connected continuously so as to form a single piece.

The covering surface 18 also comprises an additional layer 181, in the example two layers 181*a*, 181*b* (FIG. 12) made of material with a high abrasion resistance, for example leather, each being superimposed on the insert 20 made of elastic material. Each additional layer 181*a*, 181*b* covers essentially at least partly a corresponding portion of the elastic insert 20 and has a protective function.

Even more particularly, as can be seen in FIGS. 4, 5 and 12, the insert 20 made of elastic material has a superficial extension greater than the superficial extension of the two additional layers 181*a*, 181*b*. Each one of the two additional layers 181*a*, 181*b* is positioned on the elastic insert 20 so that a peripheral hem 208 of the elastic insert 20 projects and surrounds a perimetral zone of each additional layer 181*a*, 181*b*. In this way substantially the entire garment 10 is made of leather or similar material which has a high abrasion resistance, while only a strip of elastic material coinciding with said peripheral edge or hem 208 is exposed to the exterior, i.e. on an outer side 15 opposite to the inner side 14 of the portion 16 of the garment 10, i.e. visible from the outside of the garment 10.

The insert 20 made of elastic material is therefore inserted and fixed perimetrally (see FIGS. 8 and 9) by means of stitching 22 to an adjacent section 116 of the portion 16 of the garment 10 and also to the corresponding additional layer 181 which is made of material with a high abrasion resistance and covers it partially.

In particular, the stitching 22 consists of perimetral seams, i.e. extending over the entire perimeter of the elastic insert 20 and the additional layer 181.

As mentioned above, the elastic insert 20 is intended to cover the inflatable member 12 which therefore has a form similar to or compatible with that of the elastic insert 20.

Figure 2B:
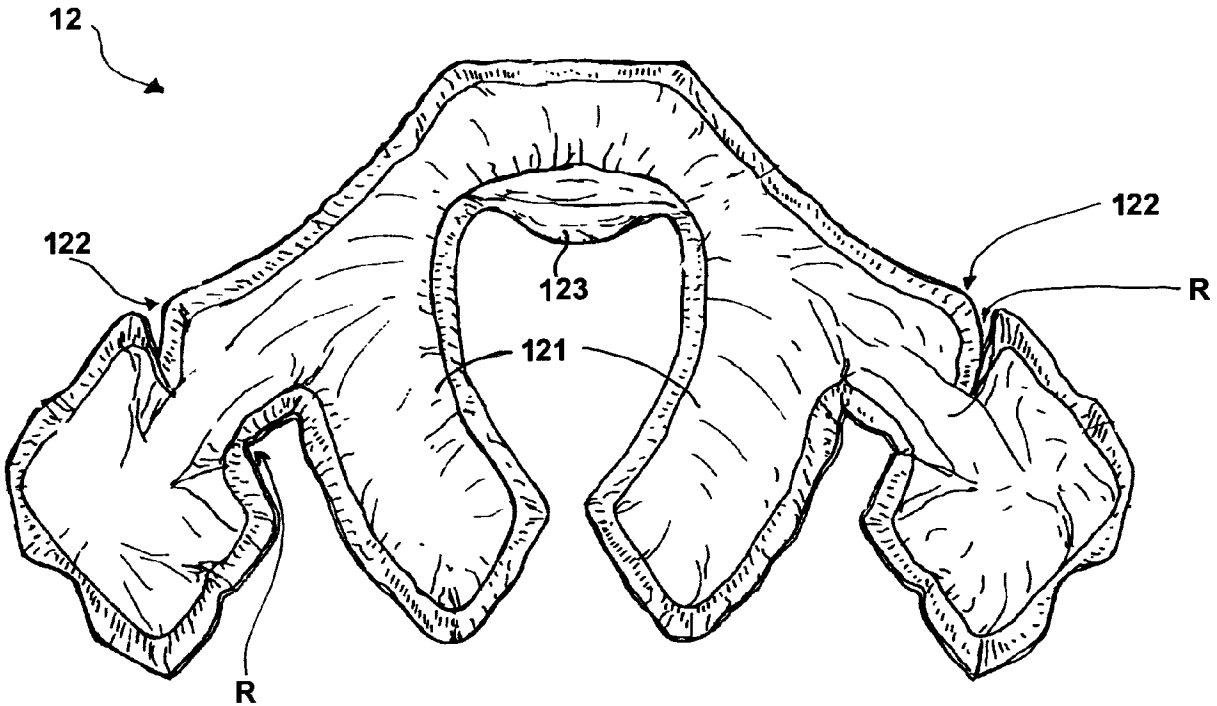
FIG. 2B shows a view, from above, of a protection device suitable for use with a garment according to the present disclosure.
Figure 2C:
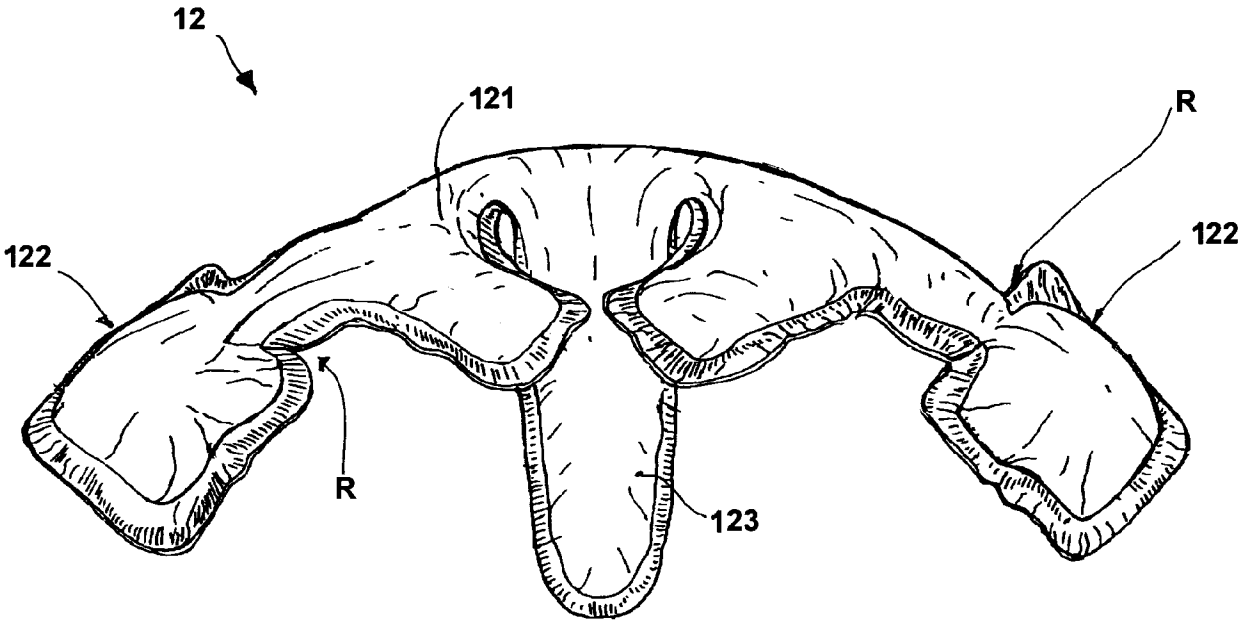
FIG. 2C shows a front view of the protection device according to FIG. 2B.

As can be seen in FIG. 10 and in FIGS. 2B, 2C, the inflatable member 12 includes a first part 121 which is substantially C-shaped and intended to be positioned in the neck region 41 and part of the chest region 42.

The inflatable member 12 also includes a second part 122 which has an elongated form and is intended to be positioned along a region which extends over a shoulder 40 of the user. In the example, the inflatable member 12 includes two second parts 122 which each extend over a respective shoulder and over a respective upper arm region 43 of the user.

The inflatable member 12 therefore has a symmetrical form with respect to a mid-sagittal plane M (indicated schematically in FIG. 1 by means of a broken line) of the user's body, i.e. a plane passing along the longitudinal and sagittal anatomical axes. As a result, the elastic insert 20 is also symmetrical with respect to the mid-sagittal plane M.

It can also be seen that each second part 122 of the inflatable member 12 between the chest region 42 and the upper arm region 43, substantially in the region of the user's armpit, has a narrower portion R.

Consequently, the second part 202 of the elastic insert 20 also forms, in this narrower region R, a curve C with its concavity directed downwards. This narrower portion R and this curve C help ensure an easier fit of the garment 10 and facilitate the movements of the user's body.

It can also be seen that the inflatable member 12 also includes a third part 123 (FIG. 10; FIGS. 2*b*, 2*c*) with an elongated form intended to be positioned along a region which extends over the spine of the user's back 45. In the example, the third part 123 is connected to the first part 121 and forms substantially an appendage to the first part 121 in the region of the spine.

In other words, the parts 121, 122, 123 of the inflatable member 12 are pneumatically connected together so as to for a single internal chamber.

It can also be seen that the garment 10 includes an additional protection of the conventional type for the spine, denoted by the reference number 50, which also has the function of an aerodynamic appendage. The third part 123 of the inflatable member 12 is inserted underneath the aerodynamic appendage 50. The aerodynamic appendage 50 is provided with a zip fastener, denoted by the reference number 55, which allows access to the third part 123 of the inflatable member 12.

Consequently the aerodynamic appendage 50 forms a covering surface/housing for the third part 123 of the inflatable member 12.

It can also be seen that the second part 202 of the elastic insert 20 (FIG. 7) extends into the rear zone of the garment 10 in the vicinity of the back of the neck 44 and is joined to the first part 201 in the zone 204 above said aerodynamic appendage 50.

In the region of the back 45, in addition to the elastic insert 20, the garment 10 also includes an elasticized strip 80 which extends over the back from one rear armpit zone of the garment 10 to the other rear armpit zone of the garment 10, passing above the aerodynamic appendage 50.

Essentially, the elasticized strip 80 comprises two oblique sections 802, 803 which extend substantially from a respective armpit zone towards the neck, and a substantially horizontal section 801 which connects the two oblique sections 802, 803; the substantially horizontal section 801 is situated in between the aerodynamic appendage 50 and the rear zone 204 of the insert 20.

Figure 11:
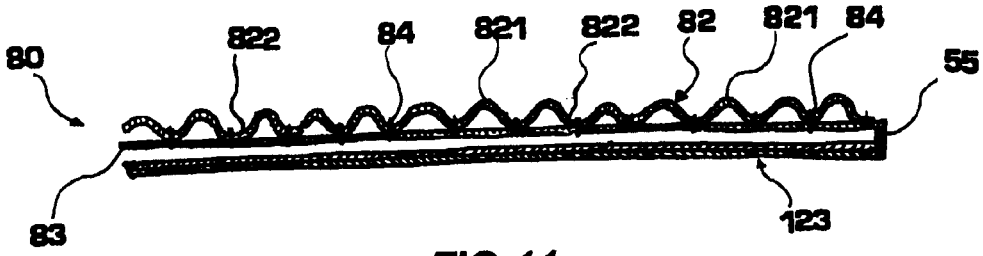
FIG. 11 shows a cross-sectional view along the line XI-XI of the garment according to FIG. 7.

Even more particularly, with reference to FIG. 11, it can be seen that the elasticized strip 80 includes a multilayer corrugated structure, in particular including a first corrugated layer 82 made of leather or similar inextensible material and a second layer 83 made of elastic fabric. The first layer 82 includes an alternating series of humps 821 and grooves 822 and is fixed to the second layer 83 by means of seams 84 along the grooves 822.

Part of the inflatable member 12, in particular a portion of the third part 123 of the inflatable member 12, is situated underneath the elasticized strip 80.

The abovementioned multilayer corrugated structure allows the elasticized strip 80 to be deformed when subject to a deforming action produced by the inflatable member 12. In fact, the elastic fabric of the second layer 83 is deformed and draws along with it the first layer 82, producing a flattening and tensioning of the humps 821 of the first layer 82.

In the example, during this flattening and tensioning action, the elasticized strip 80 doubles its width.

Owing to the typical properties of the elastic structure, the presence of the elasticized strip 80 has the advantage of allowing furthermore, like the elastic insert 20, the garment portion 10 in the region of the back 45 to adapt to the inflation of the inflatable member 12 and also helps the return movement of the inflatable member 12 into the deflated condition.

Viewing FIG. 5 it is possible to see that, owing to the elasticized strip 80, a protective ring extending as far as the region of the neck 41 and the back of the neck 44 is created above the aerodynamic appendage 50.

Moreover it can be seen that, in order to increase the protection provided, the garment 10 also includes in each articulation region of the shoulder 40 a rigid plate 52 which is made for example of titanium and which is applied on top of the garment portion 16 and the covering surface 18, namely onto the outer side 15.

With reference to FIGS. 13 to 18, these show an embodiment which is an alternative to the preceding embodiment.

In the case of this other example of embodiment, which is denoted by the reference number 110, parts which have the same function and structure retain the same reference number as in the previously described embodiment and therefore are not described again in detail.

More precisely and as shown in FIGS. 13 to 18, in this embodiment the garment 110 comprises a covering surface 182 including the insert 20 made of elastic material, where said elastic insert 20 is exposed to view externally and is therefore visible over its entire extension and is not covered by any additional layer made of inextensible material. Basically the present alternative embodiment differs from the previous embodiment in that the additional layer of leather (denoted by 181 in the previous embodiment) is absent.

In this embodiment also, the elastic insert 20, when the inflatable member 12 is in a deflated condition, is situated substantially coplanar or flush with the remainder of the portion 16 of the garment 10 adjacent thereto.

In this embodiment also, the elastic insert 20 is made of a material which has a high tear strength, for example elastic KEVLAR® (a synthetic fiber).

The remaining properties of the garment 110 substantially coincide with those already described for the garment 10 of the previous embodiment.

In the embodiments according to the present disclosure, what is important is that, when the inflatable member 12 is inflated, the elastic insert 20 is elastically deformed (as visible in FIGS. 2, 5, 14 and 16) by the expansion force of the inflatable member 12, and this allows the garment 10, 110 to adapt to the variation in volume of the inflatable member 12.

The choice of an elastic insert 20 made of material with a high tear strength helps ensure that the garment remains intact even in the inflated condition, in particular in the event of a knock or impact or sliding on the asphalt following a fall of the user.

When the inflatable member 12 is deflated, the elastic insert 20 returns into the undeformed condition owing to its elastic properties and takes with it the portion 16 of the garment (and the covering surface 18, 182) associated therewith, so as to favour compaction and further deflation of the inflatable member 12.

Basically, the housing 23 varies its volume during inflation and deflation of the inflatable member 12.

A further advantage of the presence of the insert 20 made of elastic material consists in the fact that it ensures a better fit of the portion 16 of the garment 10 and greater freedom of movement for the user in the region of the trunk and the shoulders.

It can also be seen, in order to help retain the inflatable member 12 inside the garment 1010, in particular inside the housing 23 of the portion 16 of the garment 10 or the garment 110, the inflatable member 12 has a smaller expansion volume controlled in a predetermined manner.

In particular, the inflatable member 12 comprises a plurality of tie members 90, for example threads, which are indicated schematically in FIG. 2A and distributed within the inflatable member 12, said tie members 90 being stably connected to opposite surface portions of the inflatable member 12.

Said tie members 90 have in particular a length such that, when the inflatable member 12 is in the deflated rest condition, the tie members 90 are in an untensioned condition and are collapsed within the inflatable member 12, whereas, when the inflatable member 12 is in the inflated condition, the tie members 90 are subject to a tensile force.

The use of a plurality of tie members 90 offers the advantage of ensuring a limited expansion of the inflatable member 12 in an inflated condition so as to produce a substantially flattened form of the inflatable member 12 underneath the covering surface 18, 182, and in particular obtain a limited thickness, while at the same time ensuring adequate protection for a user.

The flattened form with a small thickness also has the advantage that it limits for the user the discomfort due to an excessively bulky volume, for example should the inflatable member 12 inflate unexpectedly, namely in the event of accidental inflation of the inflation means. In fact, in this case, the inflatable member 12 in the inflated condition does not adversely affect control of the vehicle by the user and therefore does not create any risk of an accident.

Moreover, owing to the presence of a plurality of tie members 90, it is possible to obtain an inflatable member 12 which has a structure possessing a certain rigidity in the inflated condition. In fact, by suitably defining the length of the tie members in relation to the overall dimensions of the inflatable member 12 it is possible to obtain an inflatable member 12 which in the inflated condition has a certain rigidity subject only to a limited degree of flexing, thus helping ensure greater protection for a user.

With reference to FIGS. 19 to 30, the reference number 1010 denotes another embodiment of a garment according to the present disclosure; in the example the garment 1010 is a motorcyclist's riding suit, of which only the top part covering the upper body and arms can be seen.

The garment 1010 is combined with an inflatable member 1012 for protecting a user, said inflatable member 1012 comprising in the example a flexible bag made of airtight material such as polyamide and able to assume substantially a first rest condition or deflated condition and a second active operating condition or inflated condition. The modes of inflating the inflatable member 1012 will be described in the description below.

As can be seen in FIGS. 21 to 29 and as will be explained below, the inflatable member 1012 is situated on a portion 1016 of the garment 1010, in the example on a portion which covers part of the trunk (neck region 1041, chest region 1042, articulation region of the shoulders 1040), part of the back 1045 and part of the arms (upper arm region 1043) of a user.

Even more particularly, the inflatable member 1012 is hidden from view, in contact with an inner side 1014 of the portion 1016 of the garment 1010. Therefore said garment portion 1016 forms, opposite the inflatable member 1012, a covering surface 1018 for the inflatable member 1012. Namely, the portion 1016 of the garment 1010 includes a covering surface 1018 situated opposite the inflatable member 1012 so as to cover/close entirely the latter.

Consequently, the covering surface 1018 has a form and dimensions such as to cover the inflatable member 1012.

Figure 20:
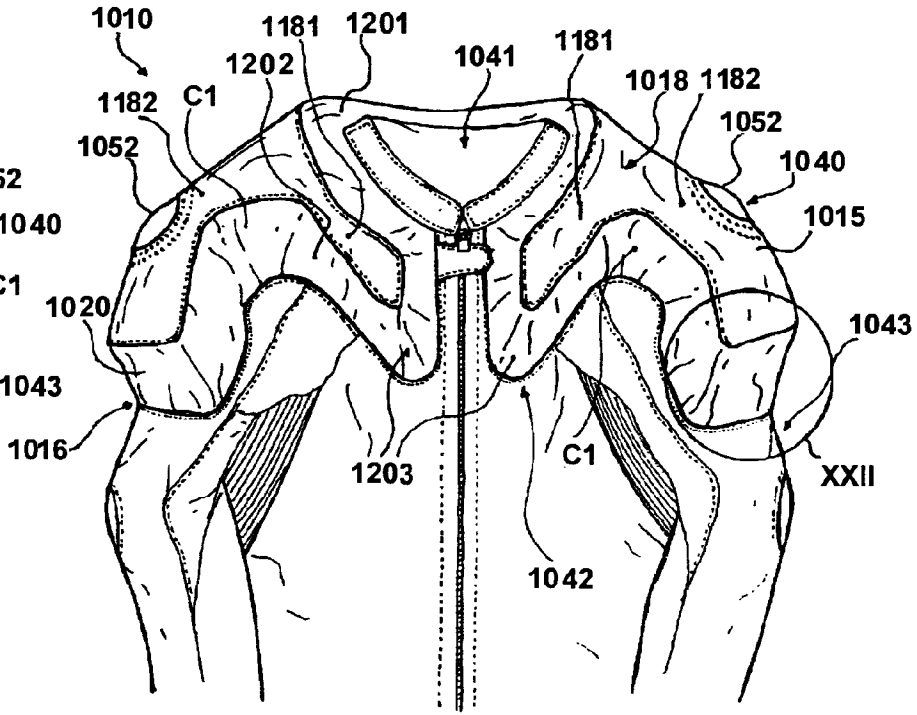
FIG. 20 shows a partial front view of the garment according to FIG. 19 in a second operating condition.
Figure 19:
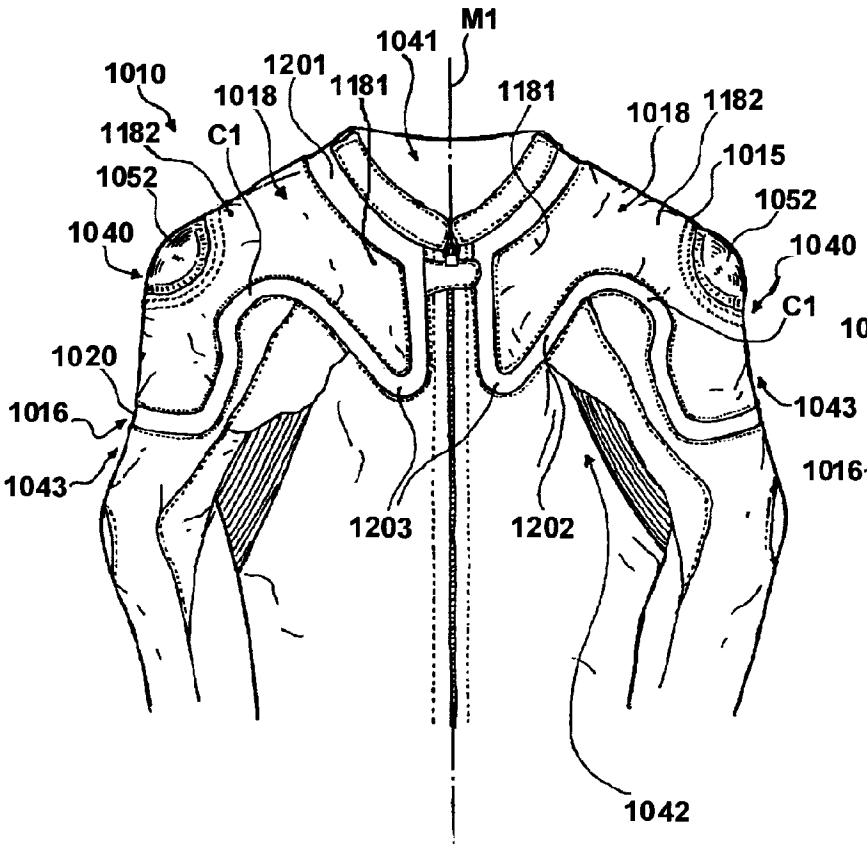
FIG. 19 shows a partial front view of a garment according to the present disclosure, in accordance with a variation of embodiment, in a first operating condition.
Figure 21:
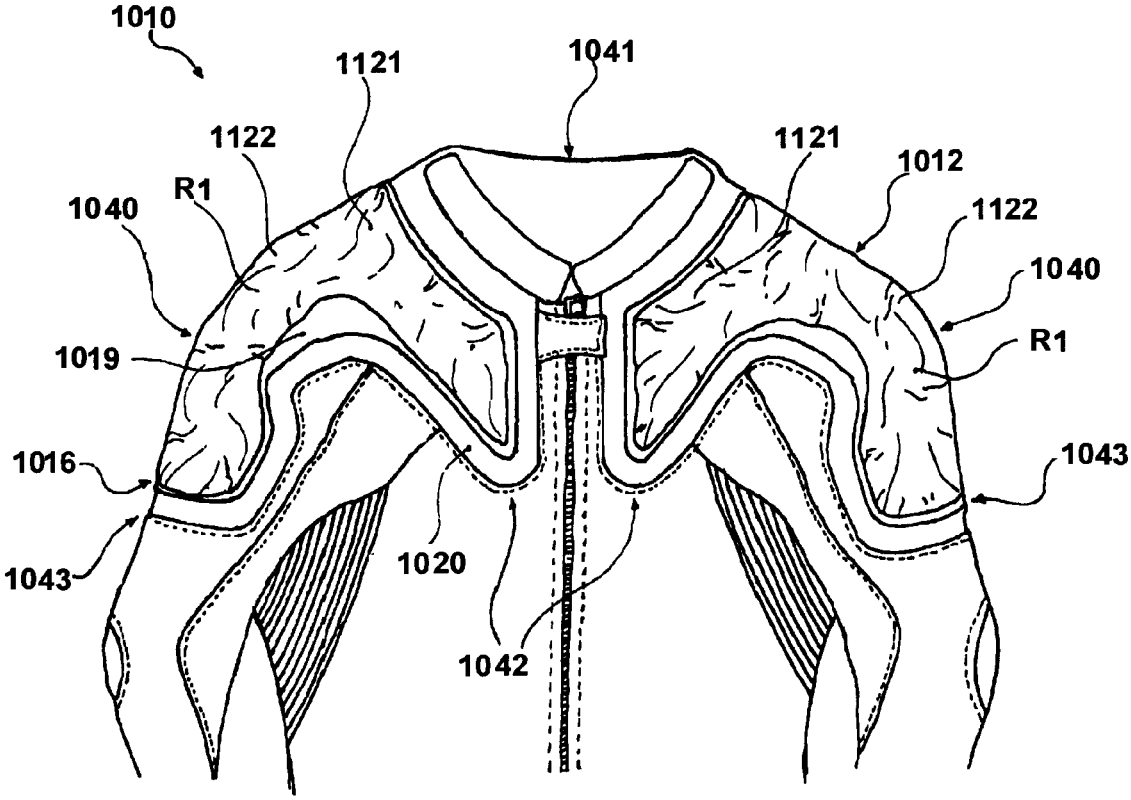
FIG. 21 shows a partial front view of the garment according to FIG. 19, partly cross-sectioned.
Figure 22:
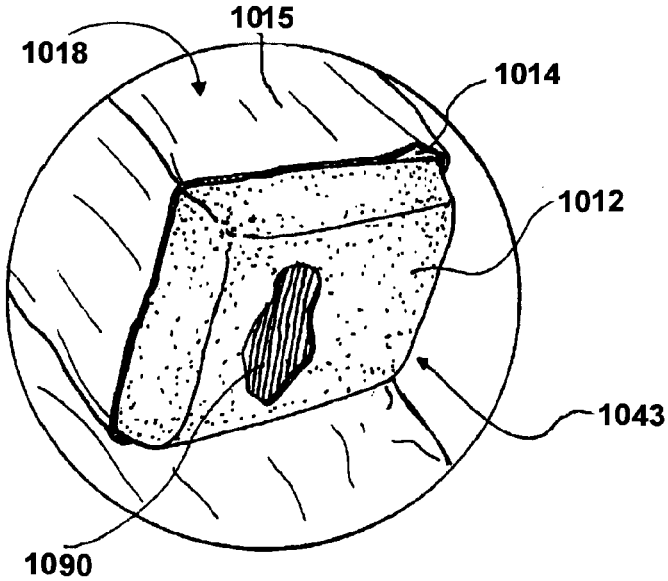
FIG. 22 shows a view of a detail XXII of FIG. 20, partly cross-sectioned and on a larger scale.
Figure 29:
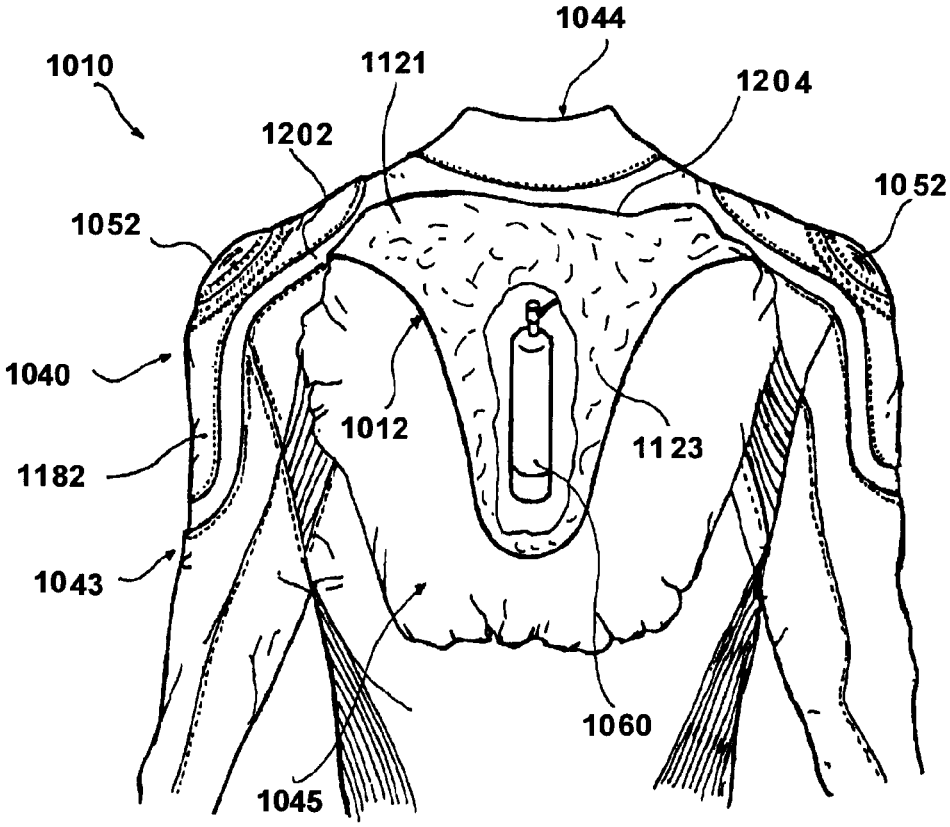
FIG. 29 shows a partial rear view of the garment according to FIG. 25, partly cross-sectioned.
Figure 30:
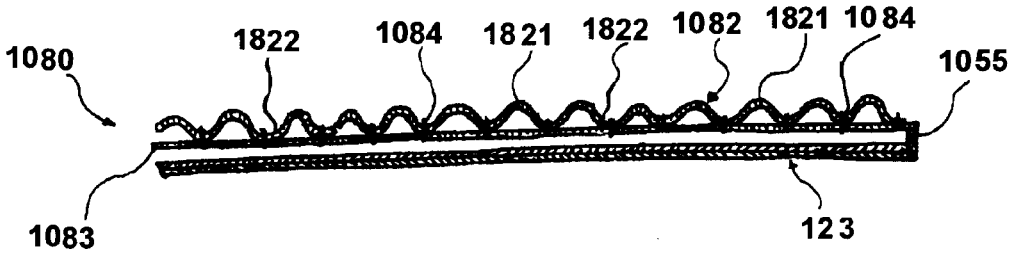
FIG. 30 shows a cross-sectional view along the line XXX-XXX of the garment according to FIG. 26.

In particular, the inflatable member 1012 is visible in the inflated condition in FIG. 22, which shows the detail XXII of FIG. 20 sectioned, and in the deflated condition in FIG. 21 and FIG. 29. In particular, in order to view the inflatable member 1012, in FIG. 21 and FIG. 29, part of the covering surface 1018 has been removed from the portion 1016 of the garment 1010.

Preferably in the example shown the garment 1010 also comprises an inner flap 1019 (visible in FIG. 21 and FIG. 28) which forms, together with the covering surface 1018, a housing 1023 or inner pocket for the inflatable member 1012. Basically, the inflatable member 1012 is stably inserted between the inner flap 1019 and the covering surface 1018 (in particular its inner side 1014). The inner flap 1019 is made preferably of a comfort—preferably breathable—fabric.

Alternatively, in order to retain the inflatable member 1012 stably underneath the covering surface 1018, the garment 1010 comprises stitches, hooks or other systems suitable for fixing an inflatable member 1012 to the covering surface 1018 or to the inner flap 1019.

Basically, as mentioned above, the inflatable member 1012 is situated stably on the portion 1016 of the garment 1010 so that said portion 1016 forms, on the outside, a cover or closure for the inflatable member 1012. The latter is therefore not visible from the outside and is stably fixed inside the housing 1023 or to the portion 1016 of the garment 1010, and therefore on the inner side 1014 facing the user.

Figure 26:
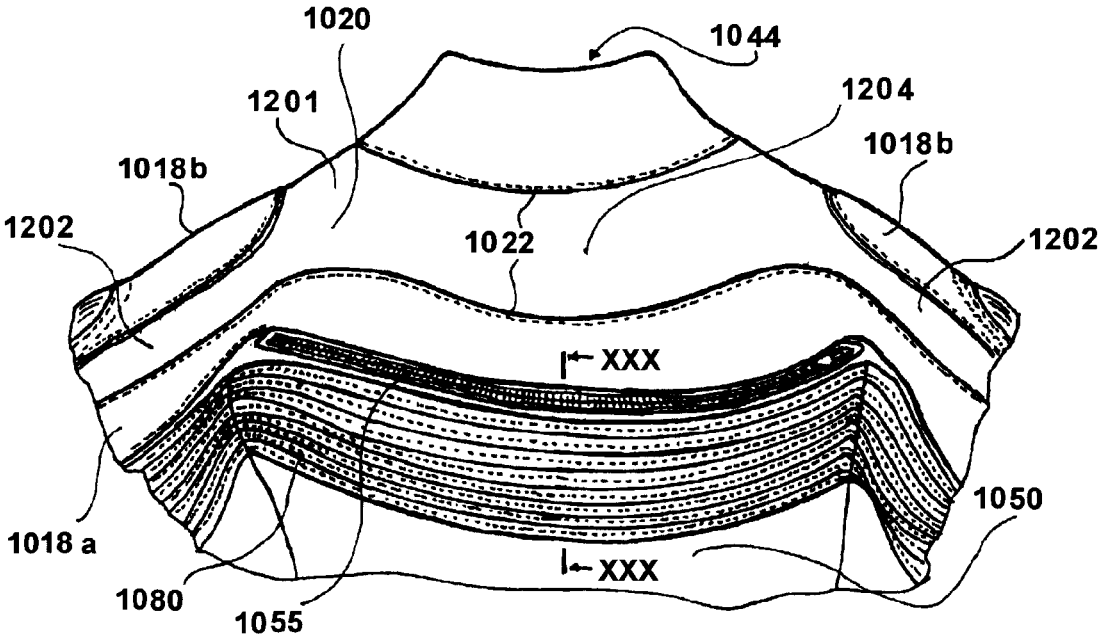
FIG. 26 shows a view of a detail, on a larger scale, of the garment according to FIG. 25.
Figure 27:
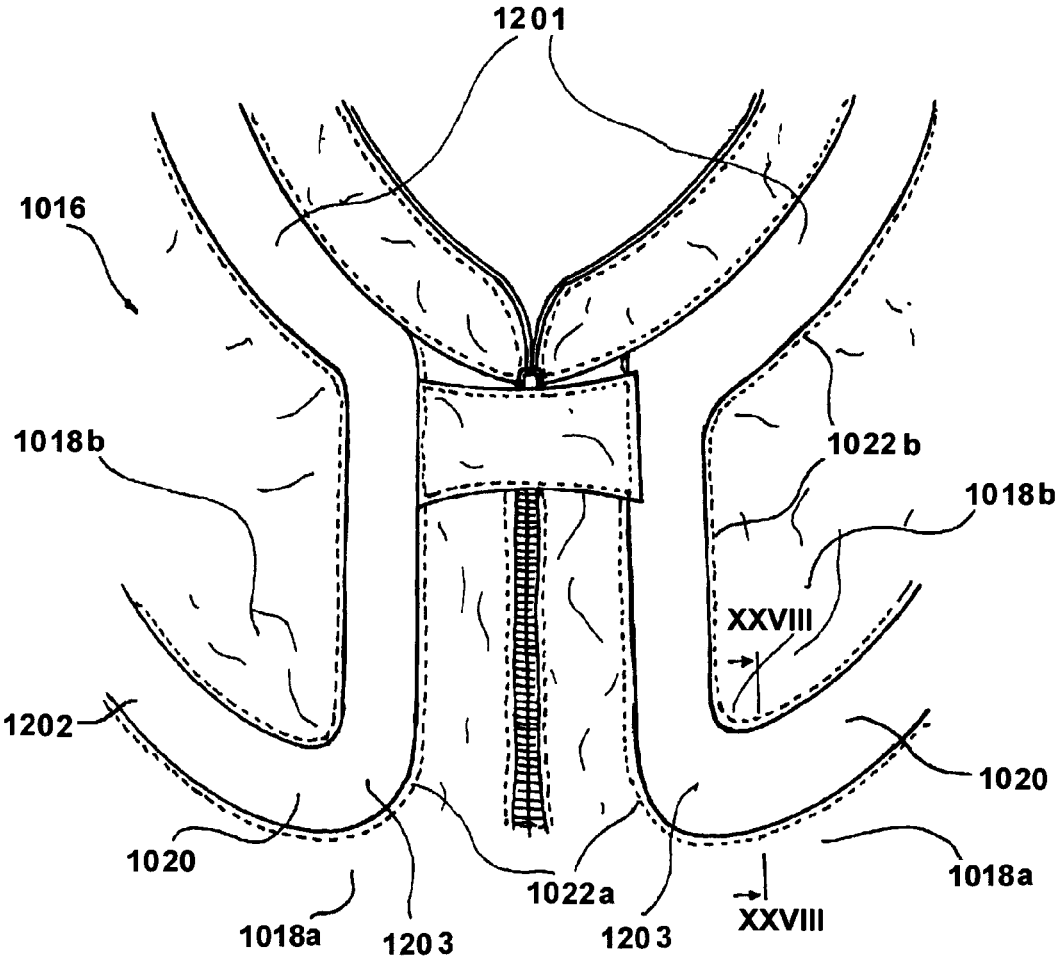
FIG. 27 shows a detail, on a larger scale, of the garment according to FIG. 19.
Figure 28:
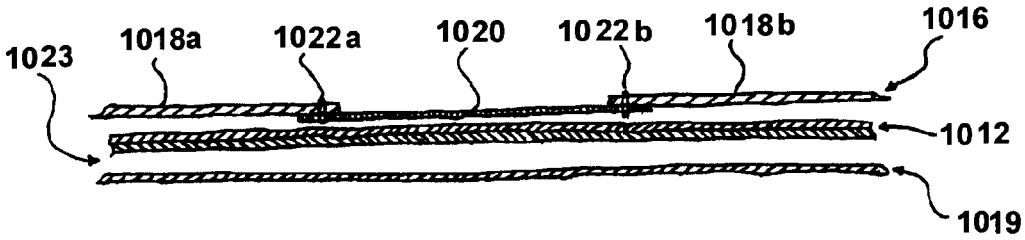
FIG. 28 shows a cross-sectional view along the line XXVIII-XXVIII of the garment according to FIG. 27.

The garment 1010 also comprises an insert 1020 which is made of elastic material and inserted within said covering surface 1018, namely forming a superficial discontinuity in said covering surface 1018. Basically the insert 1020 is inserted between neighbouring sections 1018*a*, 1018*b* of the covering surface 1018, as can be seen in FIGS. 26, 27 and 28, creating a discontinuity in the covering surface 1018.

In the example, the insert 1020 made of elastic material is fixed to the neighbouring sections 1018*a*, 1018*b* of the covering surface 1018 by means of seams 1022, in particular by means of perimetral seams 1022*a*, 1022*b*.

In this embodiment also, the elastic insert 1020, when the inflatable member 1012 is in a deflated condition, is situated substantially coplanar or flush with the remainder of the garment portion 1016 adjacent thereto.

Even more particularly, the garment portion 1016 is made mainly (except obviously for the elastic insert 1020) of an inextensible material, in the example leather or a leather-like material, able to provide the user with adequate protection.

The insert 1020 made of elastic material is therefore inserted and fixed, by means of seams 2022, to adjacent sections 1018*a*, 1018*b* of inextensible material.

In the example, more particularly the insert 1020 made of elastic material has a strip or band-like form.

Even more particularly, the insert 1020 of strip or band-like elastic material extends in the form of a closed loop within the covering surface 1018, around most of the inflatable member 1012, and more particularly over most of a perimetral/peripheral zone of the covering surface 1018 and therefore of said inflatable member 1012. Basically, the insert 1020 follows a perimetral profile of the covering surface 1018, and therefore of the inflatable member 1012, so as to allow suitable deformation of the portion 1016 of the garment 1010 opposite the inflatable member 1012, during inflation of the latter.

Figure 24:
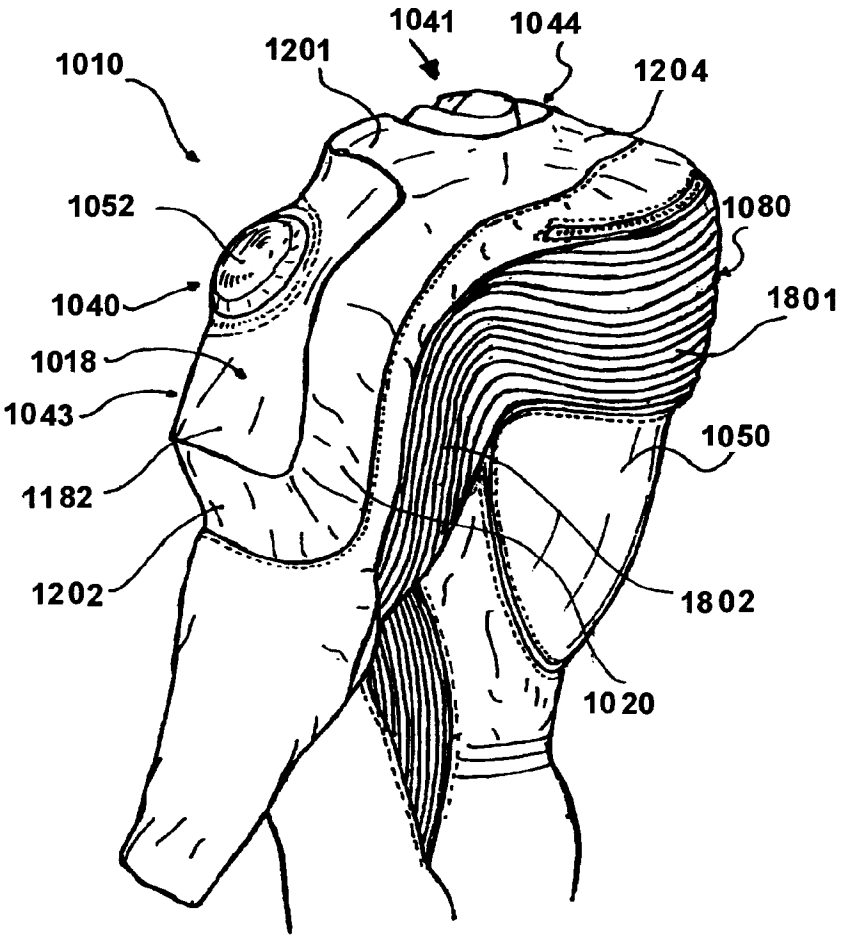
FIG. 24 shows a partial side view of the garment according to FIG. 19 in a second operating condition.
Figure 23:
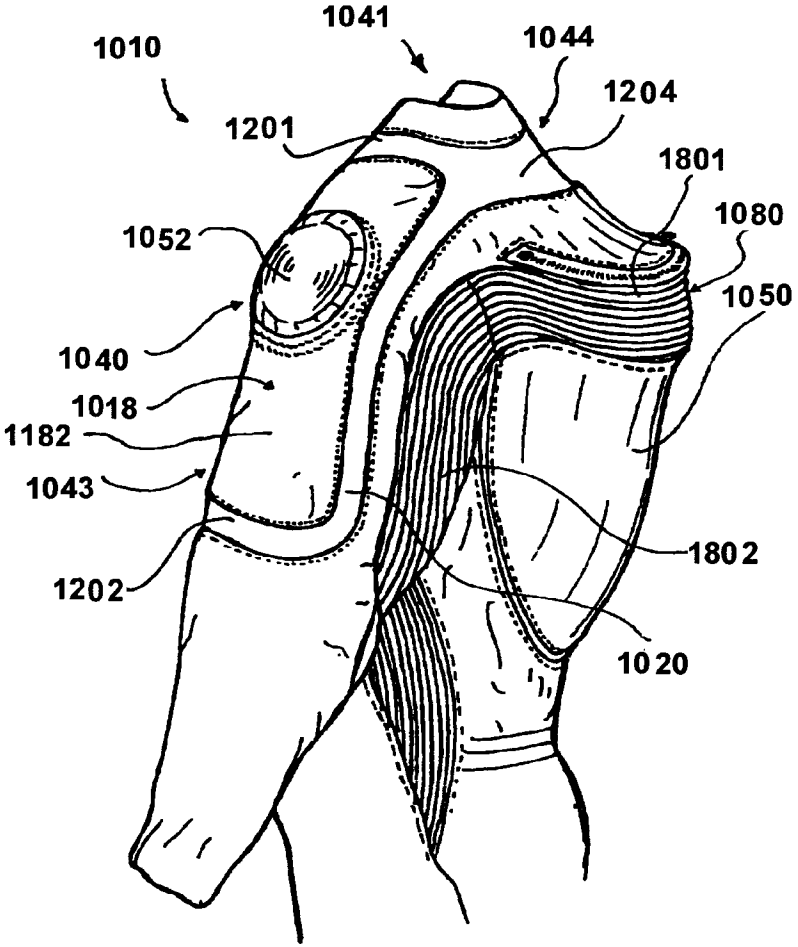
FIG. 23 shows a partial side view of the garment according to FIG. 19 in a first operating condition.
Figure 25:
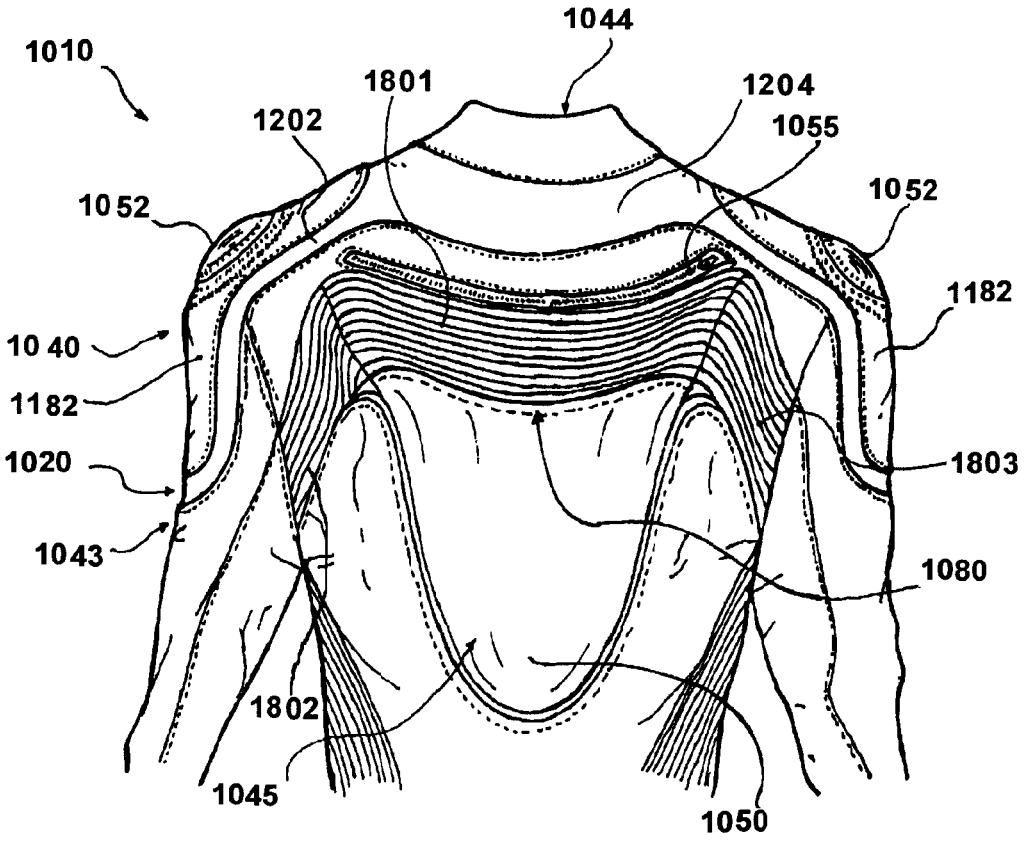
FIG. 25 shows a partial rear view of the garment according to FIG. 19.

What is important in the context of the present disclosure is that, when the inflatable member 1012 is inflated, the insert 1020 is elastically deformed (as can be seen in FIGS. 20 and 24) by the expansion force of the inflatable member 1012, and this allows the garment 1010 to adapt to a variation in volume of the inflatable member 1012. When the inflatable member 1012 is deflated, the insert 1020 returns into an undeformed condition owing to its elastic properties and takes with it the garment portion 1016 associated with it so as to favour compaction and further deflation of the inflatable member 1012.

Basically, the housing 1023 varies its volume during inflation and deflation of the inflatable member 1012.

A further advantage of the presence of the insert 1020 made of elastic material consists in the fact that it ensures a better fit of the portion 1016 of the garment 1010 and greater freedom of movement for the user in the region of the trunk and shoulders. In particular, in this connection, as can be seen from the Figures for the embodiment illustrated, the inflatable member 1012 includes a first part 1121 which is substantially C-shaped and intended to be positioned around a neck region 1041 and part of a chest region 1042 of a user. Correspondingly, the covering surface 1018 also includes a first part 1122 which is substantially C-shaped and intended to be positioned around a neck region 1041 and part of a chest region 1042 of a user.

The insert 1020 made of elastic material includes a first section 1201 which is substantially C-shaped and situated along a perimetral zone of the first part 1181 of the covering surface 1018 and the first part 1121 of the inflatable member 1012. Basically, the first section 1201 of the insert 1020 follows a perimetral profile of the first part 1181 and 1121 of the covering surface 1018 and the inflatable member 1012, respectively.

The inflatable member 1012 also includes a second part 1122 which has an elongated form and is intended to be positioned along a region which extends over a shoulder 1040 of the user. In the example, the inflatable member 1012 includes two second parts 1122, each of which extends over a respective shoulder 1040 of the user. Correspondingly, the covering surface 1018 also includes two second parts 1182, each of which extends over a respective shoulder 1040 of the user.

As a result, the inflatable member 1012 is symmetrical with respect to a mid-sagittal anatomical plane M1 (indicated schematically in FIG. 19 by a broken line) of the user's body, i.e. a plane passing along the longitudinal and sagittal anatomical axes.

The insert 1020 made of elastic material includes a second section 1202 situated along a perimetral zone of each second part 1122 and 1182 of the inflatable member 1012 and the covering surface 1018, respectively. The second section 1202 of the insert 1020 therefore follows a perimetral profile of the second part 1122 of the inflatable member 1012.

In fact, the second section 1202 extends continuously around a region of the garment 1010 intended to be positioned in an articulation zone of the shoulder 1040 of the user, from a front zone in the region of the chest 1042 and passing over the upper arm region 1043 as far as a rear zone at the back of the neck 1044 of the user.

Consequently, the insert 1020 made of elastic material is symmetrical with respect to the mid-sagittal plane M1.

It can be seen moreover that each second part 1122 of the inflatable member 1012 between the chest region 1042 and the upper arm region 1043, substantially in the region of the user's armpit, has a narrower portion R1.

Consequently each second section 1202 of the insert 1020 also forms, in this narrower region R1, a curve C1, with its concavity directed downwards. This narrower portion R1 and this curve C1 ensure a better fit of the garment 1010 and facilitate the movements of the user's body.

It can also be seen that the first section 1201 of the insert 1020 is connected to said second section 1202 in the region of the chest 1042, where this joining zone is denoted by 1203, and in the region of the back of the neck 1044 of the user, where this joining zone is denoted by 1204.

The inflatable member 1012 also includes a third part 1123 (FIG. 29) which has an elongated form and is intended to be positioned along a region which extends opposite the spine of the user's back 1045. In the example, the third part 1123 is connected to the first part 1121 and forms substantially an appendage to the first part 1121 along the spine.

Essentially it can be seen that the inflatable member 1012 is identical to the inflatable member 2 of the previous embodiment shown in FIGS. 2B, 2C.

It can also be seen that the garment 1010 includes an additional protection of the conventional type for the spine, denoted by the reference number 1050, having also the function of an aerodynamic appendage. The third part 1123 of the inflatable member 1012 is inserted underneath the aerodynamic appendage 1050. The aerodynamic appendage 1050 is provided with a zip fastener—denoted by the reference number 1055—which allows access to the third part 123 of the inflatable member 1012.

Consequently the aerodynamic appendage 1050 forms a covering surface/housing for the third part 1123 of the inflatable member 1012.

It can also be seen that the two sections 1202 of the insert 1020 (FIG. 26) extend in the rear zone of the garment in the vicinity of the region of the back of the neck 1044 and are joined to the first section 1201 in the joining zone 1204 above said aerodynamic appendage 1050.

In the region of the back 1045, in addition to the insert 1020, the garment 1010 also comprises an elasticized strip 1080 which extends over the back from a rear armpit zone of the garment 1010 to the other rear armpit zone of the garment passing above the aerodynamic appendage 1050.

Basically, the elasticized strip 1080 comprises two oblique sections 1802, 1803 which extend substantially from a respective armpit zone towards the neck, and a substantially horizontal section 1801 which connects the two oblique sections 1802, 1803; the substantially horizontal section 1801 is situated between the aerodynamic appendage 1050 and the joining zone 1204 of the insert 1020.

The elasticized strip 1080 is also contained within the covering surface 1018, producing a superficial discontinuity, in a similar manner to the abovementioned insert 1020.

The elasticized strip 1080 therefore has the same function as the elastic insert 1020. Even more particularly, with reference to FIG. 30, it can be seen that the elasticized strip 1080 includes a multilayer corrugated structure, in particular including first corrugated layer 1082 made of leather or similar inextensible material, and a second layer 1083 made of elastic fabric. The first layer 1082 includes an alternate series of humps 1821 and grooves 1822 and is fixed to the second layer 1083 by means of stitches 1084 along the grooves 1822.

Part of the inflatable member 1012, in particular a portion of the third part 1123 of the inflatable member 1012, is situated underneath the elasticized strip 1080.

The abovementioned multilayer corrugated structure allows the elasticized strip 1080 to be deformed by a deforming action of the inflatable member 1012. In fact, the elastic fabric of the second layer 1083 is deformed and draws along with it the first layer 1082, producing a flattening and tensioning of the humps of the first layer 1082. Basically, the elasticized strip 1080 doubles its width.

Owing to the typical properties of the elastic structure, the presence of the elasticized strip 1080 has the advantage that it further allows, like the insert 1020 made of elastic material, the portion of the garment 1010 along the back 1045 to adapt to the inflation of the inflatable member 1012 as well as help the inflatable member 1012 to return into the deflated condition.

Viewing FIG. 24, it can be seen that, owing to the elasticized strip 1080, a protective ring which extends as far as the region of the neck 1041 and the back of the neck 1044 of the user is created above the aerodynamic appendage 1050.

It can also be seen how, in order to increase the protection provided, the garment 1010 also includes in each articulation region of the shoulder 1040 a rigid plate 1052—made of titanium in the example—which is applied above the garment portion 1016, namely on an outer side 1015 opposite to the inner side 1014.

Each second section 1202 in the upper arm region 1043 passes below the plate 1052, surrounding the latter.

In order to perform inflation of the inflatable member 12, 1012 of the preceding embodiments, in the event of a fall and/or sliding and/or impact involving a user or a vehicle on which he/she is travelling, the garment 1010 comprises special activation and inflation means, of which only a compressed-gas canister 60, 1060 is shown by way of example, this being arranged in the example inside the third part 123, 1123 of the inflatable member 12, 1012 in turn included, as mentioned, underneath the aerodynamic appendage 50, 1050.

Alternatively, these activation and inflation means may comprise gas generators of the pyrotechnic or hybrid type or other types known in the present art.

Said inflation means are operated by a control unit by means of sensing the state of the vehicle/rider system; for example said control unit may activate a fall prediction system which allows identification in advance of a fall and reliable prediction thereof by means of speed sensors which are integral with the vehicle (or rider) and a unit for processing the signals produced by the said sensors.

Alternatively, the device according to the present disclosure can also be applied using an actuating cable connected to a vehicle ridden by a user, which cable causes inflation of the inflatable member following separation of the user from the vehicle, for example following a fall or impact.

In any case the aforementioned activation and inflation means may be incorporated in the garment according to the present disclosure or located on the outside thereof.

It should be noted also that the activation means, despite being an aspect of particular importance for effective inflating operation of the inflatable member 12, 1012, will not be further described in greater detail since they are essentially methods already known to a person skilled in the art.

Preferably, the garment 1010 also comprises a deflation valve (not shown and of the conventional type, communicating on one side with the inflatable member 12, 1012 and on the other side with the external environment, in order to allow deflation of the inflatable member 12, 1012 following inflation and when a protective action on the part of the inflatable member 12, 1012 itself is no longer required.

This deflation valve, which is normally in the closed position, is for example opened manually by the user, in particular a rider during a race, when, owing to accidental activation or following a fall which resulted in activation of the canister 60, 1060, the rider wishes to continue the race, without the member 12, 1012 in the inflated condition impeding the movements or affecting the aerodynamics. Opening of the deflation valve has the effect that, as a result of the difference in pressure between the inflated member 12, 12, 1012 and the external environment, the gas flows out through the valve and the member 12, 1012 deflates, favoured by the return of the insert 20, 1020 and/or the elasticized strip 80, 1080 into the undeformed condition.

It is also mentioned that, in order to favour retention of the inflatable member 1012 inside the garment 1010, in particular inside the housing 1023, the inflatable member has an expansion volume which is smaller and controlled in a predetermined manner.

In particular, the inflatable member 1012 comprises a plurality of tie members 1090, in the example threads, which are shown schematically in FIG. 22 and distributed in the inflatable member 1012, said tie members 1090 being stably connected to surface portions of the inflatable member 1012.

Said tie members 1090 have in particular a length such that, when the inflatable member 1012 is in the deflated rest condition, the tie members 1090 are in an untensioned condition, collapsed inside the inflatable member 1012, whereas when the inflatable member 1012 is in the inflated condition, the tie members 1090 are under tension.

The use of a plurality of tie members 1090 has the advantage that it ensures a limited expansion of the inflatable member 1012 in an inflated condition so as to produce a substantially flattened form of the inflatable member 1012 underneath the covering surface 1018, and in particular so as to obtain a limited thickness, while at the same time ensuring adequate protection for a user.

The flattened form with a small thickness also has the advantage that it limits for the user the discomfort due to an excessively bulky volume, for example should the inflatable member 1012 inflate unexpectedly, namely in the event of accidental inflation of the inflation means. In fact, in this case, the inflatable member 1012 in the inflated condition does not adversely affect control of the vehicle by the user and therefore does not create any risk of an accident.

Moreover, owing to the presence of a plurality of tie members 1090, it is possible to obtain an inflatable member 1012 which has a structure possessing a certain rigidity in the inflated condition. In fact, by suitably defining the length of the tie members in relation to the overall dimensions of the inflatable member 1012 it is possible to obtain an inflatable member 1012 which in the inflated condition has a certain rigidity subject only to a limited degree of flexing, thus helping ensure greater protection for a user.

With reference to FIGS. 31 to 37, the reference number 2001 denotes a personal protection device suitable for being combined with a garment according to the present disclosure, similarly to those devices described with reference to FIGS. 1 to 30, or in FIGS. 43 and 44, and in particular suitable for being arranged underneath a garment according to the present disclosure.

In particular, the protection device 2001 comprises an inflatable member 2002 inside which an internal chamber 2003 is defined, said inflatable member 2002 being able to assume substantially a first rest condition or deflated condition and a second active condition or inflated condition. The modes of inflating the inflating the inflatable member 2002 will be described in the description below.

The protection device 2001 comprises a plurality of tie members 2005 which are distributed inside the internal chamber 2003 and are stably connected to respective portions of the inflatable member 2002, in particular to surface portions thereof.

In the example the tie members 2005 are thread-like and consist of flexible and inextensible members. Therefore, they are suitably designed with dimensions such that, when the inflatable member 2002 is in the rest condition, they are preferably not under tension and are in a collapsed condition inside the internal chamber 2003, whereas, when the inflatable member 2002 is in the inflated condition, they are subject to a tensile force, as shown by way of example in FIGS. 34 and 35.

In a variation of embodiment of the subject of the present disclosure, the tie members 2005, in addition to being thread-like and flexible, are elastic members. Therefore, they are suitably designed with dimensions such that, when the inflatable member 2002 is in the rest condition, they are preferably not under tension or only slightly tensioned, whereas, when the inflatable member 2002 is in the inflated condition, they are tensioned so as to have a greater extension and a greater tension. According to one aspect of the present disclosure, the tie members 2005 are advantageously distributed densely within the inflatable member 2002, for example with a density of at least of one tie member per $cm^2$ of surface area of the internal chamber 2003, and even more preferably, again by way of example, with a density of between 1 and 15 threads every $cm^2$ of surface area of the inflatable member 2, preferably between 4 and 6 threads every $cm^2$.

Figures 34, 35, 36, 37:
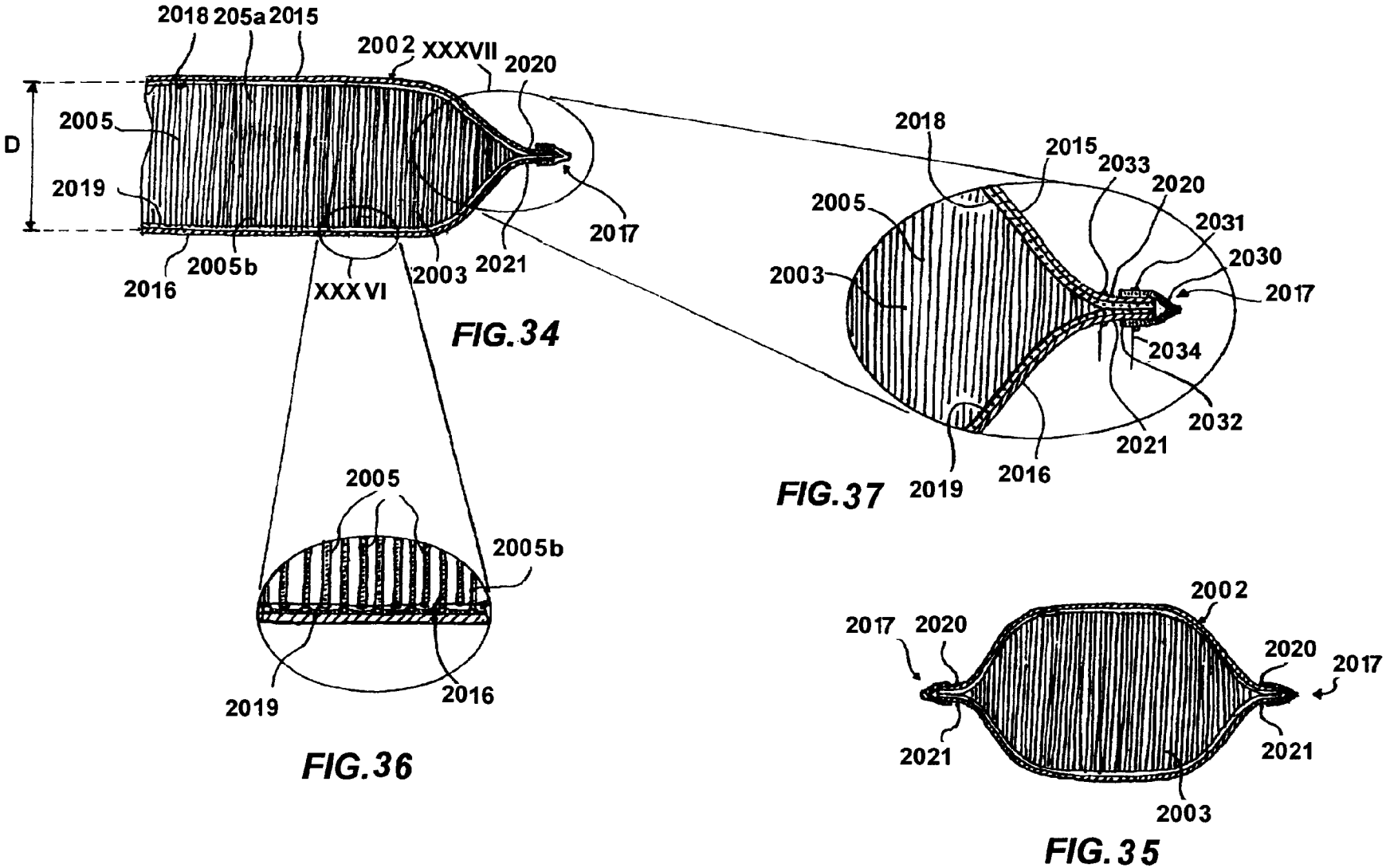
FIG. 34 shows a cross-sectional view along the line XXXIV-XXXIV of FIG. 32.
FIG. 35 shows a cross-sectional view along the line XXXV-XXXV of FIG. 32.
FIG. 36 shows a detail XXXVI-XXXVI of FIG. 34 on a larger scale.
FIG. 37 shows a detail XXXVII-XXXVII of FIG. 34 on a larger scale.
Figure 38:
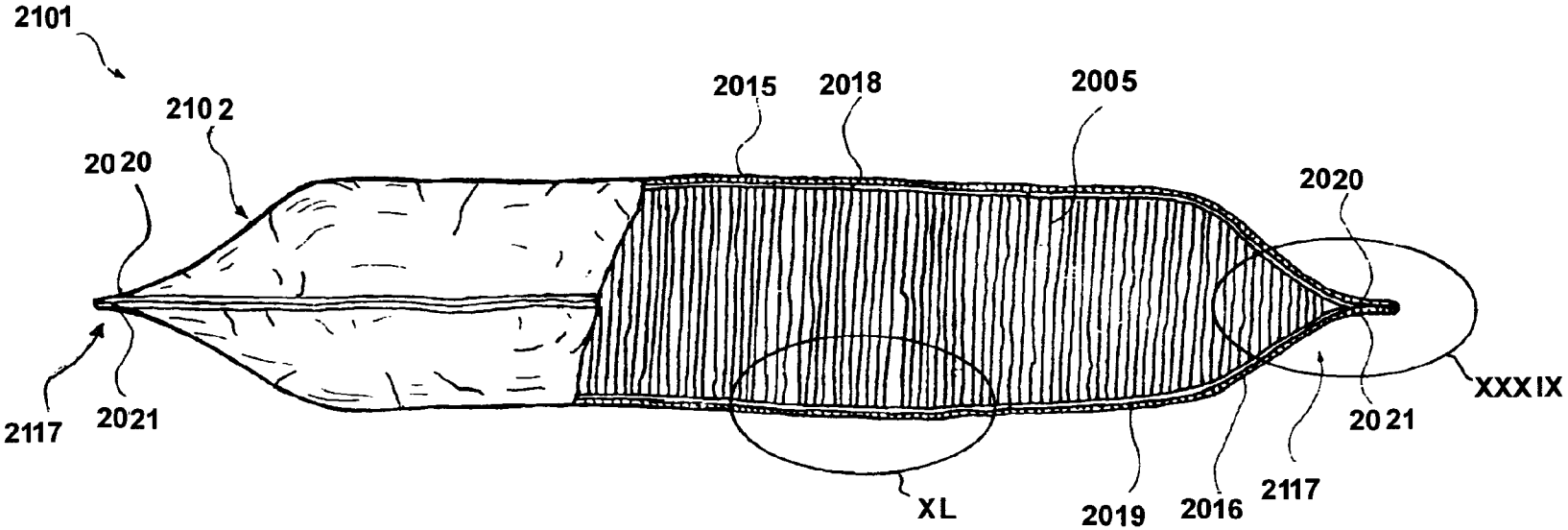
FIG. 38 shows a cross-sectional view of a protection device, in accordance with a variation of embodiment, suitable for being combined with a garment according to the present disclosure.
Figure 40:
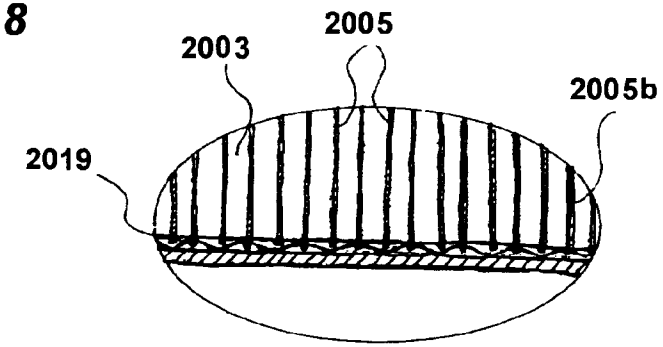
FIG. 40 shows a detail XL of FIG. 38 on a larger scale.
Figure 39:
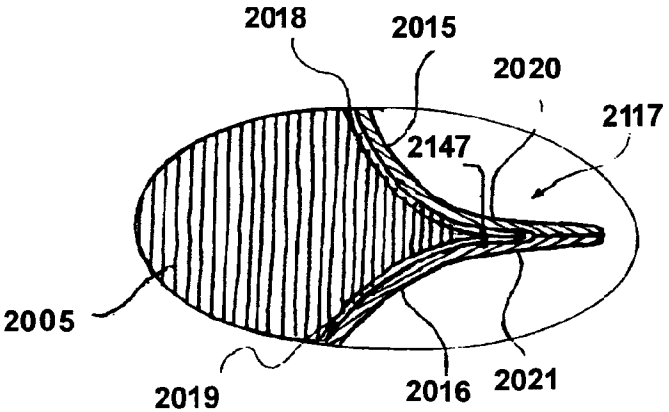
FIG. 39 shows a detail XXXIX of FIG. 38 on a larger scale.

Viewing the cross-sections shown in FIGS. 34 and 35, it can be seen that the tie members 2005 are distributed in a substantially homogeneous manner inside the internal chamber 2003.

Figure 31:
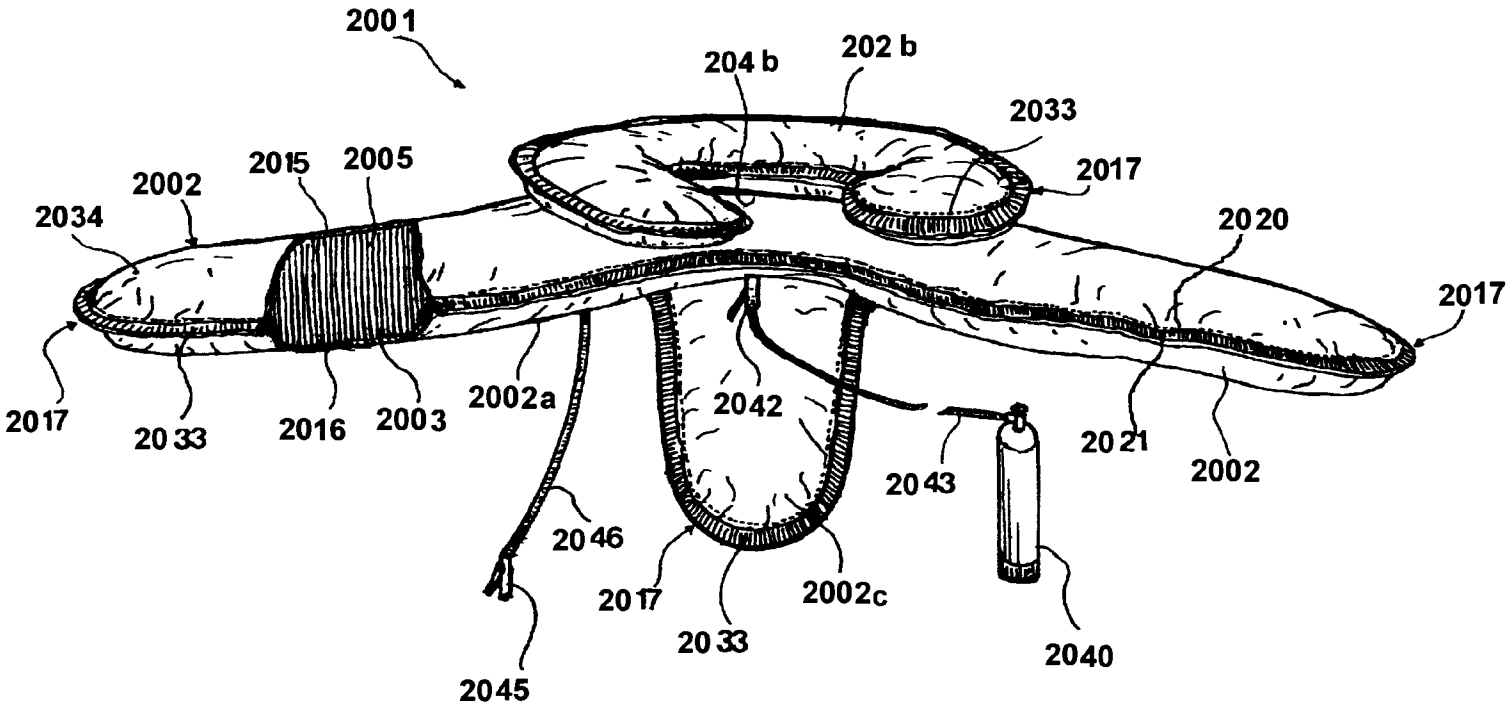
FIG. 31 shows a partly sectioned perspective view of a protection device suitable for being combined with a garment according to the present disclosure, in an inflated condition.
Figure 32:
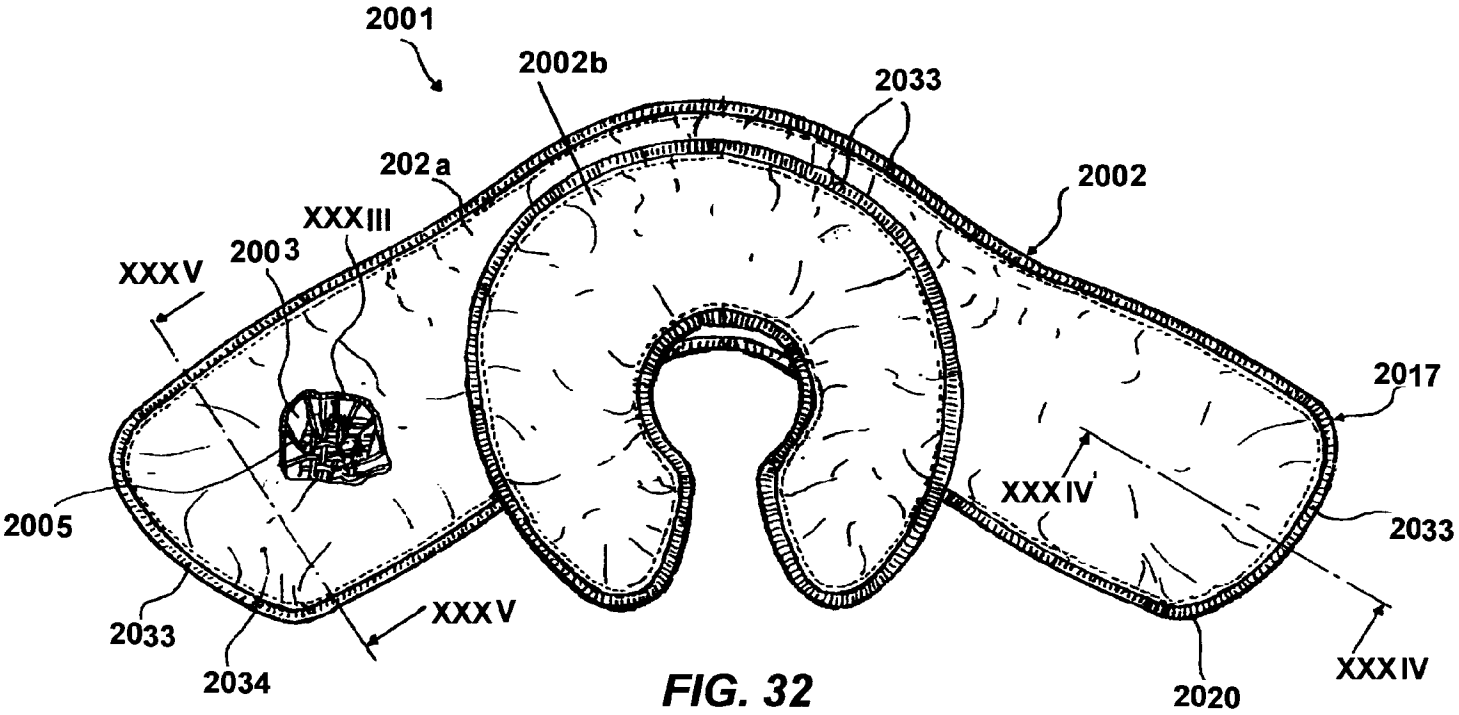
FIG. 32 shows a view, from above, of the protection device according to FIG. 31, partly cross-sectioned.
Figure 33:
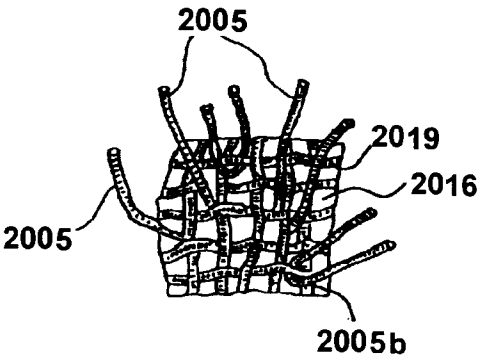
FIG. 33 shows a view of a detail XXXIII of FIG. 32.

In the example shown by way of example in FIGS. 31 and 32, the inflatable member 2002 can be worn on the body and comprises three regions 2002*a*, 2002*b*, 2002*c*, i.e.:

- a first region 2002*a* which in the figures is arranged substantially horizontal and has a slightly curved elongated form and is intended to be positioned on the shoulders of a user;
- a second region 2002*b* which is substantially C-shaped and arranged above and parallel to the first region 2002*a* and which is intended to be positioned around the neck of user, acting substantially as a collar; and
- a third region 2002*c* which has an elongated form and is arranged substantially perpendicular to the first region 2002*a* and to the second region 2002*b*, namely arranged on one side of the first region 2002*a* which is opposite to that of the second region 2002*b* and intended to protect a portion of the spine of a user.

Essentially, the first region 2002*a* is arranged between the second region 2002*b* and the third region 2002*c*.

The three regions 2002*a*, 2002*b*, 2002*c* are pneumatically connected together so as to form the member 2002 and a single internal chamber 2003, similar to the inflatable member 12, 1012 according to FIGS. 2*b*, 2*c*.

In the example, all three regions 2002*a*, 2002*b*, 2002*c* are formed by opposite walls 2015, 2016 which are perimetrally sealed along respective perimetral edges 2020, 2021, or lips, and are provided with said tie members 2005.

Consequently, for the sake of brevity of the description below, reference will be made to only one of said regions, for the example the first region 2002*a*, although the same description is also applicable to the remaining regions 2002*b*, 2002*c*. It is understood nevertheless that in another possible embodiment of the protection device said tie members 2005 may be arranged only in one or in some of the regions 2002*a*, 2002*b*, 2002*c*.

More precisely, the region 2002*a* of the inflatable member 2002 comprises at least said two walls 2015, 2016 or sheets which are formed by a sheet of flexible and gas-tight material, for example polyamide or polyurethane, and are arranged opposite each other and fixed perimetrally along the above-mentioned perimetral edges 2020, 2021 by means of a sealing edge 2017 which will be described in more detail below. The tie members 2005 are arranged between the walls 2015 and 2016.

Figure 42:
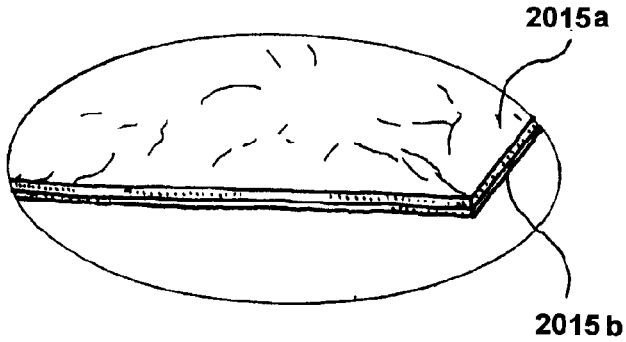
FIG. 42 shows a detail XLII of FIG. 41.

In one variation of embodiment, the walls 2015, 2016 are made of a laminate which is normally used as a lining for clothing and includes a layer of fabric 2015*a* (FIG. 42), in the example a layer of 100% nylon (which constitutes about 65% by weight of the laminate) and a layer of glue 2015*b*, in the example a film of glue (which constitutes about 35% by weight of the laminate), for example polyurethane glue, which is distributed over the layer of fabric 2015*a* by mean of spreading with a roller.

As mentioned above, in the example the tie members 2005 are flexible tie members and have a thread-like form and are made for example of polyester or polyamide, with a thickness of between about 500 and about 1000 decitex (units of length of a continuous thread or a yarn) and have ends 2005, 2005*b* which are fixed to the respective wall portions 2015, 2016 which they connect. Even more particularly, each tie member or thread 2005 includes a bundle of continuous untwisted fibres which protrude from one point of a respective mesh 2018, 2019.

The inflatable member 2002 comprises in fact meshes 2018, 2019, each of which lines internally, i.e. on the side of the internal chamber 2003, a respective wall 2015, 2016.

The term "mesh" is understood in the context of the present disclosure as referring to a porous patch or piece of cloth which has a mesh-like appearance.

The term "wall" or "sheet" is understood in the context of the present disclosure as referring to a member for covering a respective mesh, whereby the first and second wall are joined together so as to define a chamber inside which the first and second mesh and the tie members which connect the first and second meshes are arranged.

Figure 41:
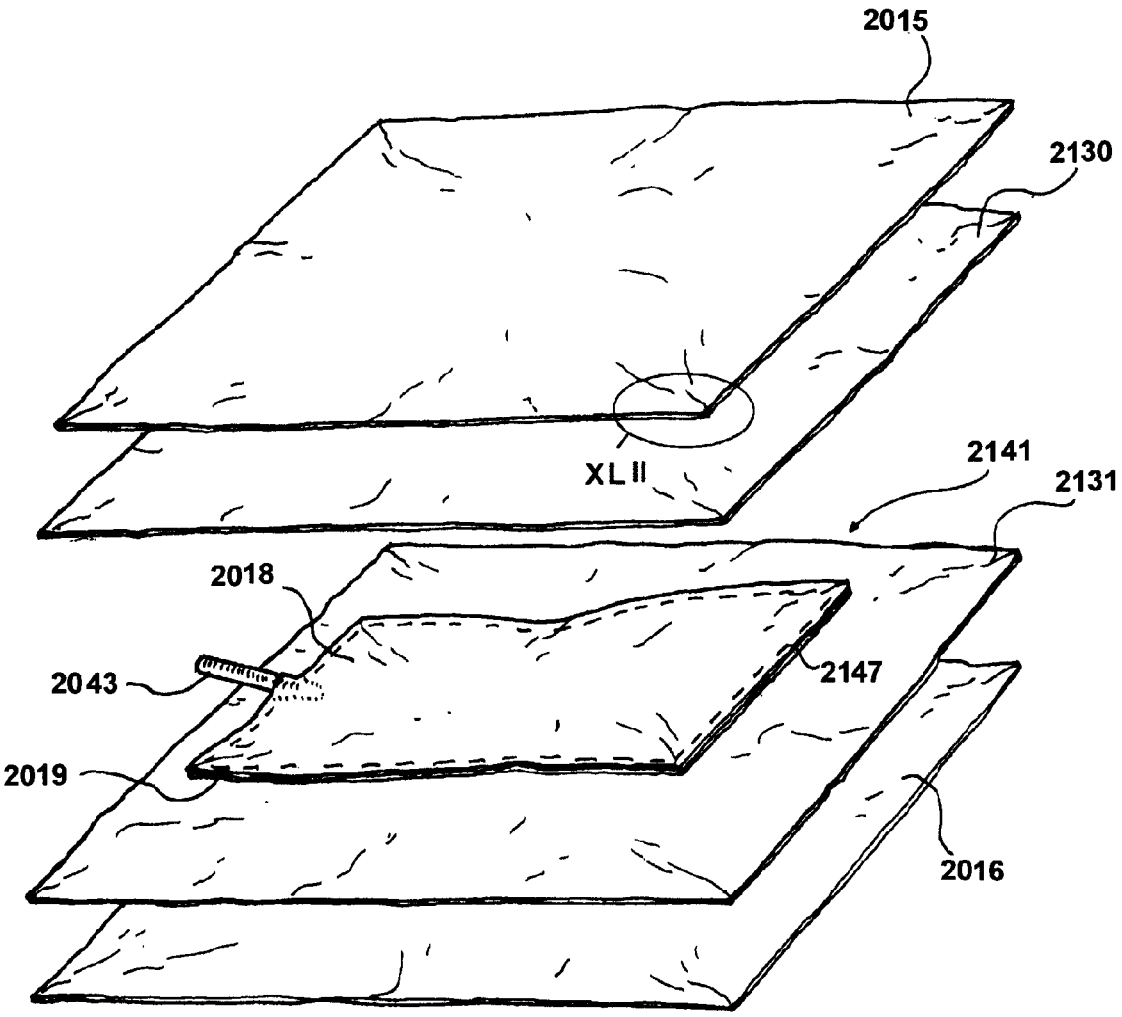
FIG. 41 shows a protection device according to the present disclosure, with parts separated.

Even more particularly each mesh 2018, 2019 is fixed stably to the surface of the respective wall 2015, 2016 by means of a film of glue (denoted for example by the number 2130, 2131 in FIG. 41) or similar fixing systems.

In the case where the laminate is used, the film of glue is arranged in contact with the layer of glue 2015*b* of the laminate.

The tie members 2005 have opposite ends 2005*a*, 2005*b* which are stably fixed to the mesh 2018, 2019 of the respective wall 2015, 2016. Fixing at the opposite ends 2005*a*, 2005*b* of the tie members 2005 is achieved, for example, by means of simple insertion of the tie members 2005 between the wefts of the mesh 2018, 2019.

Basically, in the example shown in the figures, the tie members 2005 are formed by means of a given number of threads which are fixed alternately to one mesh 2018 and consecutively to the other mesh 2019. In other words, each thread 2005 is threaded underneath a weft of the mesh 2019 of the wall 2016, is curved upwards and is extended again towards the opposite wall 2015, where it is connected in the same manner to the mesh 2018.

Alternatively the tie members 2005 are connected to the mesh 2018, 2019 by means of interweaving or tying or similar fixing systems.

Alternatively, each tie member 2005 is a thread which is interlaced integrally with or extends continuously from both said first and second meshes 2018, 2019. Basically, the thread/tie member 2005 extends from one of said first and second meshes 2018, 2019 and is interlaced integrally with the other one of said first and second meshes 2018, 2019.

The assembly consisting of the two meshes 2018 and 2019 and the tie members 2005 forms a so-called three-dimensional or double-knit fabric.

The meshes 2018 and 2019 are also made of polyester or polyamide.

The protection device described above is made in the following manner according to a first embodiment.

A pair of meshes 2018, 2019 are arranged in opposite positions at a predefined distance and have, fastened thereto, or as mentioned above fixed thereto in another manner, ends 2005*a*, 2005*b* of the tie members 2005, whereby the length of said tie members 2005 is chosen so as to define a maximum mutual distance D between the meshes 2018, 2019 corresponding to a maximum local expansion of the member 2002 in the inflated condition.

Then each mesh 2018, 2019 is fixed so as to adhere to a respective wall 2015, 2016, for example by means of glue, i.e. each mesh 2018 and 2019 lines the respective wall 2015, 2016.

Then, respective opposite perimetral edges 2020, 2021 of the walls 2015 and 2016 are arranged on top of each other and joined together along the perimeter so as to form the internal chamber 2003 and enclose internally the meshes 2018, 2019.

In order to ensure a sealed closure of the internal chamber 2003, the connection between the perimetral edges 2020, 2021 of the two walls 2015, 2016 is achieved by means of the abovementioned edging 2017 which includes a membrane 2030 (FIG. 37). In particular, the membrane 2030 preferably consists of a triple layer comprising an adhesive layer for the adhesion, to the wall of the inflatable member, of at least one intermediate polyurethane film and an external mesh layer (with an anti-scratch function for protecting the underlying polyurethane film).

Even more particularly, the membrane 2030 is in the form of a tape which is folded longitudinally so as to form two facing hems 2031, 2032. In particular, the membrane 2030 receives, between said facing hems 2031 and 2032, the pair of perimetral edges 2020, 2021 of the walls 2015, 2016.

The hems 2031, 2032 of the membrane 2030 are stitched together by means of one or more seams 2034 so as to fix inside them also the perimetral edge 2020, 2021 of the walls 2015, 2016, as shown in FIG. 37. A further seam 2033 is provided in the vicinity of the membrane 2030 so as to join stably together the overlapping edges 2020, 2021 of the walls 2015, 2016, before fixing the membrane 2030. In order to ensure air-tightness, the seams 2033 and 2034 are taped (for example heat-taped) using methods which are substantially within the competence of a person skilled in the art.

It can be seen from the figures that the two meshes 2018, 2019 are also perimetrally fixed directly together by means of the seams 2033 and also the seams 2034 of the membrane 2030. In other words, the meshes 2018, 2019 are not connected together only by means of the tie-members 2005, but also fixed perimetrally together so as to make direct contact. These therefore consist of seams 2033 which follow the perimetral profile of the inflatable member 2002.

From the above description it can be understood that the two walls 2015 and 2016 are essentially two parts or sheets of the inflatable member 2002 which are arranged opposite each other and fixed together along the respective perimetral edges 2020 and 2021. It is also possible in any case for the two walls 2015 and 2016 to consist of opposite portions of a single sheet folded in the manner of a book and therefore having perimetral edges extending along a portion of the perimeter and closed by means of sealing tape.

In order to perform inflation of the inflatable member 2002, in the event of a fall and/or sliding and/or unexpected impact on the part of the user or a vehicle being travelled on, the protection device 2001 according to the present invention is able to co-operate with special activation means which are operationally connected to inflation means, of which a canister 2040 containing compressed cold gas is shown only by way of example in the figures. The canister 2040 is connected by means of a tube 2043 or pipe to a shut-off valve 2042 which is fixed to the inflatable member 2002 and which allows the introduction of an inflating fluid inside the inflatable member 2002.

The canister 2040 may also be included inside the inflatable member 2002.

Alternatively, these inflation means may comprise gas generators of the pyrotechnic or hybrid type or other types known from the prior art.

Said inflation means are operated by a control unit which operates by means of sensing of the state of the vehicle/rider system; for example said control unit may activate a fall prediction system which allows identification in advance of a fall and reliable prediction thereof by means of speed sensors which are fixed to the vehicle (or rider) and a unit for processing the signals produced by the sensors.

Alternatively, the device according to the present disclosure can also be applied using an actuating cable connected to a vehicle ridden by a user, which cable controls inflation of the inflatable member 2002 following separation of the user from the vehicle, for example following a sudden impact or fall.

In any case the aforementioned activation and inflation means may be incorporated in the protection device 2001 according to the present invention or located on the outside thereof.

It should be noted also that the activation means, despite being an aspect of particular importance for effective operation of the device, will not be further described in greater detail since they are essentially methods already known to a person skilled in the art of protecting a person from sudden impacts.

The protection device 2001 also comprises a deflation valve 2045 communicating on one side with the internal chamber (for example by means of a small pipe 2046) and on the other side with the external environment, in order to allow deflation of the inflatable member 2002 following activation and when a protective action is no longer required. This deflation valve 2045, which is normally in the closed position, is for example opened manually, for example via removal of a closing cap, by the user, in particular a rider during a race, when, owing to accidental activation or following a fall which resulted in activation of the device 2001, the rider wishes to continue the race, without the member 2002 in the inflated condition impeding the movements or affecting the aerodynamics. Opening of the deflation valve 2045 has in fact the effect that, owing to the difference in pressure between the internal chamber 2003 of the inflatable member 2002 and the external environment, the gas escapes from the internal chamber 2003 and the inflatable member 2002 deflates. Tie members 2005 with elastic properties may assist said deflation, pulling said first wall 2015 and second wall 2016 towards each other.

Alternatively, activation of the inflation valve 2045 may be controlled by an electronic control unit (not shown) which opens the deflation valve 2045 when a predefined time period (for example 15 seconds) has lapsed following activation of the inflation means. With reference to FIGS. 38 to 42, a personal protection device 2101 according to another embodiment is described below, said device being able to be combined with a garment according to the present disclosure, similar to those devices illustrated in FIGS. 1 to 30 or in FIGS. 43 and 44.

Components and parts of the present embodiment which have the same function and the same structure as the components and parts of the embodiment previously described retain the same reference number and are not described in detail again.

In particular, the personal protection device 2101 comprises an inflatable member 2102 including a structure formed by the two meshes 2018, 2019 forming basically two layers; the two meshes 2018, 2019 are situated facing each other and connected by means of a plurality of tie members 2005. The meshes 2018, 2019 are cut to size along a contour, having a profile with a form depending on the intended use of the inflatable member 2102.

The structure including the two meshes 2018, 2019 and the tie members 2005 is included between two walls 2015, 2016 so as to form a kind of sandwich. The walls 2015, 2016 adhere to the respective meshes 2018, 2019, for example are joined by means of glue. Moreover, the walls 2015, 2016 are perimetrally fixed together, along peripheral edges 2020, 2021, namely in an edge zone 2117. In particular it can be seen in FIGS. 38, 39, 41 that the meshes 2018, 2019 have a superficial extension which is smaller than the superficial extension of the respective walls 2015, 2016, so that, when the meshes 2018, 2019 with the tie members 2005 are included between the walls 2015, 2016, the peripheral edges 2020, 2021 of the walls 2015, 2016 are directly fixed together in a sealed manner, for example glued, without the inclusion, in a peripheral or perimetral zone, of the meshes 2018, 2019.

A method for producing a protection device according to the present disclosure, as an alternative to or in combination with that described above, is now described, this being able to be used in particular in order to produce the device 2101 described above or for the protection device 2001 or for the devices 10, 110, 1010.

A portion or structure 2141 comprising meshes 2018 and 2019, to which ends 2005*a*, 2005*b* of tie members 2005 are fastened or fixed in another way, is firstly provided. The mesh 2018 is stitched together with the mesh 2019 along the perimeter by means of a seam denoted by 2147 in FIG. 41.

Before completing the seam 2147, a tube for 2043 for connection to a canister 2040 is included between the meshes 2018, 2019. If necessary, similar to the tube 2043, the small pipe 2046 (not shown in FIG. 41) may be included for connection to the deflation valve 2045. Alternatively, as mentioned above, the canister 2040 may be included directly between the meshes 2018, 2019, and the tube 2043 may be replaced by the small pipe 2046.

The structure 2141 is enclosed between the sheets 2015, 2016 of flexible and gas-tight material, for example made of polyurethane or polyamide or the above-mentioned laminate, whereby the sheets 2015, 2016 have a superficial extension greater than that of said structure 2141.

In the example, the sheets 2015 and 2016 are glued to the respective meshes 2018, 2019 by means of a film of glue, in the example a polyurethane film having a thickness of about 100 μm, denoted by the numbers 2130, 2131, using a hot press (which for example operates at temperatures of between about 140° C. and 180° C., preferably at about 150° C.) so as to favour adhesion and gluing together.

Peripheral edges 2020, 2021 of the walls 2015, 2016 are glued directly together. The structure 2141 thus remains enclosed inside the internal gas-tight chamber defined by the walls 2015, 2016.

Figure 43:
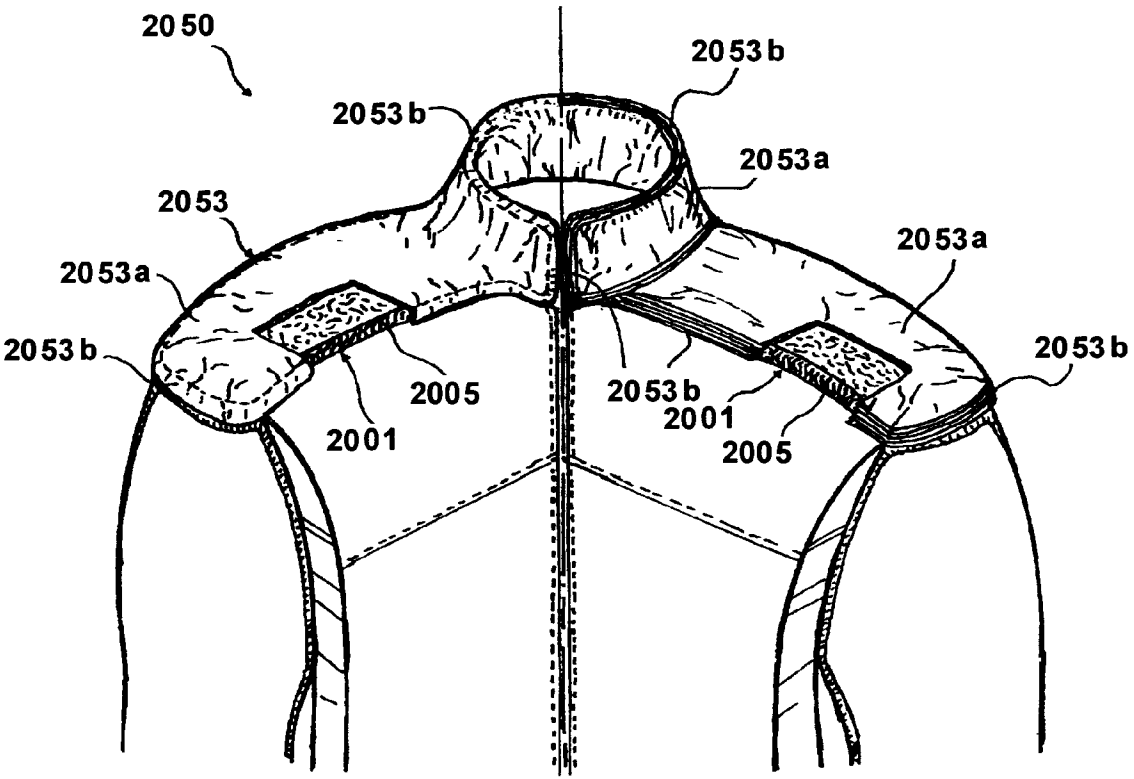
FIG. 43 shows a garment including a protection device according to the present disclosure, in a deflated condition and partly cross-sectioned.
Figures 44, 45:
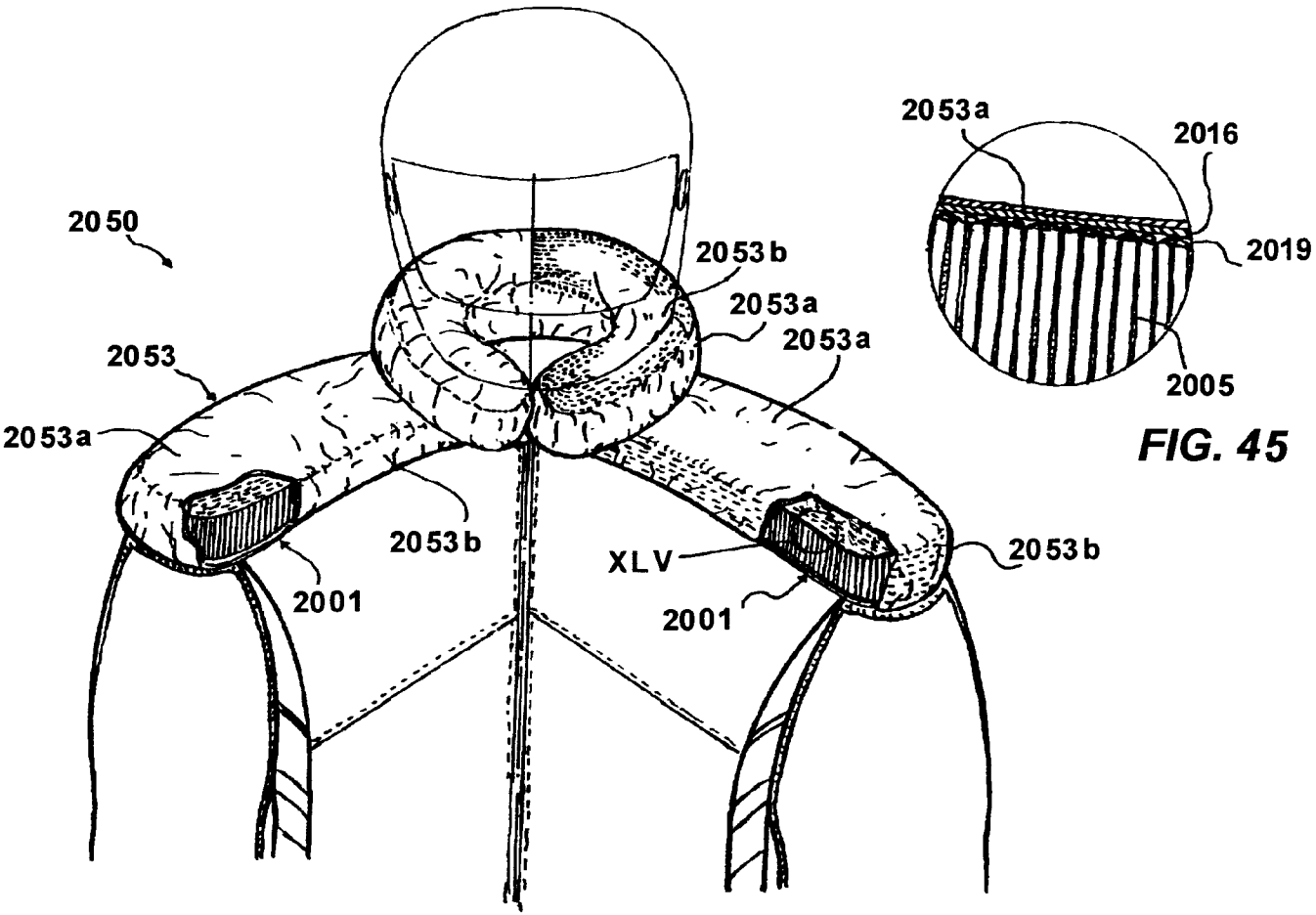
FIG. 44 shows a garment including a protection device according to the present disclosure, in an inflated and partly sectioned condition.
FIG. 45 shows a detail XLV of FIG. 44.

With reference to FIGS. 43, 44 and 45 this shows a portion of a garment 2050 according to the present disclosure, which garment 2050 includes for example the protection device 2001, namely that shown in FIGS. 31 to 37 or the device 2101 described in FIGS. 38 to 42.

In particular, the garment 2050 is a motorcyclist's riding suit.

In particular the garment 2050 comprises containing means intended to house the protection device 2001.

In the example according to FIGS. 43 and 44, in accordance with the form of the protection device 2001 described above, the containing means are arranged on a surface visible on the outside of the garment, along the shoulders of the garment, around the collar of the garment, and in the upper central region of the back.

In particular, for each portion 2002*a*, 2002*b*, 2002*c* of the inflatable member 2002, the containing means comprise a pocket 2053 or casing which is substantially closed and unique, which extends over the shoulders, the neck and part of the back, and inside which the inflatable member 2002 is completely inserted. The pocket 2053 shown therefore projects from the garment.

More precisely, with reference to the garment 2050 which can be seen in FIGS. 43 and 44, the pocket 2053 is formed by an outer flap 2053*a*, a side wall 2053*b*, which extends along the whole perimeter of the protection device 2001, and by an inner flap, not visible in the drawings, which is situated in the vicinity of the user's body.

In FIGS. 43 and 44, the pocket 2053 is shown partly cross-sectioned so as to be able to see the protection device 2001 housed inside.

It should also be noted that, in FIGS. 43 and 44, the pocket 2053 has been shown on purpose differently in the right-hand half and left-hand half of the figure so as to illustrate two different ways of forming the pocket 2053.

In particular, in a first embodiment, shown in the right-hand half of FIG. 43 and FIG. 44, the side wall 2053*b* of the pocket has a pleated form, i.e. comprises a plurality of folds extending parallel to the perimetral edges 2020, 2021 of the portions 2002*a*, 2002*b* of the inflatable member 2002, for example by using a sheet of fabric of greater length and/or superficial extension, suitably folded. Preferably, when the inflatable member 2002 is in the rest condition, the folds are stably fixed by means of seams stitched using threads with a preset breakage tension and the pocket 2053 is substantially collapsed with a minimum volume towards the inside of the garment 2050. When the inflatable member 2002 extends into the inflated condition (FIG. 44), said seams break and the pocket 2053 extends exploiting the greater extension of the side wall 2053*b*. In other words, these seams are suitably tensioned to break during inflation so as to allow expansion of the inflatable member 2002 inside the pocket 2053.

In particular, in a second embodiment, shown in the left-hand half of FIG. 43 or FIG. 44, the pocket 2053 is made of a material of the extensible or alternatively elastic type, such as lycra.

In this case, the pocket 2053 is formed so that, when the inflatable member 2002 is in the deflated rest condition, the pocket 2053 is in a substantially undeformed condition, collapsed preferably against the user's body, whereas when the inflatable member 2002 is in an inflated condition, the pocket 2053 is in a deformed condition, under tension. Preferably, in this case also, when the inflatable member 2002 is in the deflated condition, the pocket 2053 is kept fixed by means of threads with a preset breakage tension.

In a variation of this second embodiment, only the side wall 2053*b* of the pocket 2053 is made of an extensible or elastic material, while the remainder of the pocket 2053 (i.e. the outer flap 2053*a* and the inner flap) is made of inextensible material.

In a further variant it is possible to have a pocket 2053 having a side wall 2053*b* which is both pleated and made of elastic material.

Both these embodiments offer the particular advantage of ensuring that the rider has a suit with an optimum aerodynamic form in the riding condition when the inflatable member 2002 is deflated, owing to the fact that the pocket 2053 is in the collapsed condition with a minimum volume. At the same time, if necessary, the pocket 2053 is able to contain the inflatable member 2002 in the inflated condition, both preventing the inflatable member from being damaged during impact and ensuring in any case a certain aerodynamic form.

The provision of a pocket 2053 which is able to contain the inflatable member 2002 even when the latter is in the inflated condition is made possible by the fact that the inflatable member 2002, owing to the presence of the tie members 2005, assumes a predetermined three-dimensional form in particular of limited thickness.

Moreover, deflation of the inflatable member 2002 following activation, owing to opening of the deflation valve 2045, is preferably assisted by the elastic properties of the pocket 2053 which tends to return into its rest condition. Therefore, following deflation of the inflatable member 2002, the outer appearance and the aerodynamic characteristics of the garment 2050 are substantially identical to those prior to activation of the inflation means, allowing the rider to continue easily the race (albeit with the protection device 2001 no longer effective in the event of a further fall).

The subject of the present disclosure has been described hitherto with reference to preferred embodiments. It must be understood that there may exist other embodiments which embrace the same inventive idea, all falling within the scope of protection of the following accompanying claims.

The invention claimed is:

1. A garment comprising a portion suitable for being combined with an inflatable member for protecting a user, said portion including a covering surface suitable for forming a covering for said inflatable member, said covering surface comprising at least one insert made of elastic material, and an elasticized strip which extends over a region of the user's back from one armpit zone to the other armpit zone, wherein the elasticized strip includes a first corrugated layer made of leather or inextensible material and a second layer made of elastic fabric, the first layer including an alternating series of humps and grooves and being fixed to the second layer by means of stitches along the grooves.

2. The garment according to claim 1, wherein said insert made of elastic material is substantially inserted inside said covering surface so as to form a discontinuity in the covering surface.

3. The garment according to claim 1, wherein said covering surface includes at least one additional protective layer arranged over said insert made of elastic material, said additional protective layer covering at least partly said insert made of elastic material, and wherein said insert made of elastic material has a superficial extension greater than that of said additional layer, and said additional layer is arranged over said insert so that a peripheral hem of said insert made of elastic material surrounds a perimetral zone of said additional layer.

4. The garment according to claim 1, wherein said insert includes a first part occupying a neck region and partially a chest region of the garment and a second part having an elongated form and occupying at least one zone which extends from an articulation region of one shoulder to the articulation region of an other shoulder passing via a back region, and wherein said second part of the insert extends from one upper arm region passing over a rear zone in the region of the back of the neck as far as an other upper arm region.

5. The garment according to claim 1, wherein said insert made of elastic material extends at least partially along a perimetral zone of said covering surface.

6. The garment according to claim 1, said garment being a motorcyclist's riding suit or jacket.

7. The garment according to claim 1, wherein the elasticized strip comprises two oblique sections which extend substantially from a respective armpit zone towards a neck region of the user, and a substantially horizontal section which extends above an aerodynamic appendage.

8. A garment comprising a portion suitable for being combined with an inflatable member for protecting a user, said portion including a covering surface suitable for forming a covering for said inflatable member, said covering surface comprising at least one insert made of elastic material, the garment including said inflatable member, said inflatable member being positioned hidden from view and in contact with an inner side of said covering surface, wherein said inflatable member includes a plurality of tie members which are situated inside said inflatable member and are stably fixed to surface portions of said inflatable member, wherein said tie members have dimensions such that, when said inflatable member is in a deflated rest condition, said tie members are in an untensioned condition and collapsed inside the inflatable member, whereas when said inflatable member is in an inflated condition, said tie members are under tension, wherein said inflatable member includes a first wall and a second wall which are fixed together along respective perimetral edges so as to form an internal chamber, a first mesh which lines internally at least partly said first wall, and a second mesh which lines internally at least partly said second wall, said tie members having opposite ends which are fixed respectively to said first mesh and to said second mesh.

9. The garment according to claim 8, wherein said insert made of elastic material is substantially inserted inside said covering surface so as to form a discontinuity in the covering surface.

10. The garment according to claim 8, wherein said covering surface includes at least one additional protective layer arranged over said insert made of elastic material, said additional protective layer covering at least partly said insert made of elastic material, and wherein said insert made of elastic material has a superficial extension greater than that of said additional layer, and said additional layer is arranged over said insert so that a peripheral hem of said insert made of elastic material surrounds a perimetral zone of said additional layer.

11. The garment according to claim 8, wherein said insert includes a first part occupying a neck region and partially a chest region of the garment and a second part having an elongated form and occupying at least one zone which extends from an articulation region of one shoulder to the articulation region of the other shoulder passing via a back region, and wherein said second part of the insert extends from one upper arm region passing over a rear zone in the region of the back of the neck as far as the other upper arm region.

12. The garment according to claim 8, wherein said insert made of elastic material extends at least partially along a perimetral zone of said covering surface.

13. The garment according to claim 8, said garment being a motorcyclist's riding suit or jacket.

14. The garment according to claim 8, wherein said tie members have a threaded form.

* * * * *